US008590729B2

(12) United States Patent
Kamineni et al.

(10) Patent No.: US 8,590,729 B2
(45) Date of Patent: Nov. 26, 2013

(54) CONTAINER BASE HAVING VOLUME ABSORPTION PANEL

(75) Inventors: Satya Kamineni, Lockport, IL (US); Michael R. Mooney, Frankfort, IL (US); Monis Bangi, Woodridge, IL (US)

(73) Assignee: Constar International LLC, Philadelphia, PA (US)

( * ) Notice: Subject to any disclaimer, the term of this patent is extended or adjusted under 35 U.S.C. 154(b) by 578 days.

(21) Appl. No.: 12/413,043

(22) Filed: Mar. 27, 2009

(65) Prior Publication Data

US 2009/0242575 A1 Oct. 1, 2009

Related U.S. Application Data

(60) Provisional application No. 61/040,067, filed on Mar. 27, 2008.

(51) Int. Cl.
*B65D 90/32* (2006.01)

(52) U.S. Cl.
USPC ..... 220/609; 220/608; 220/624

(58) Field of Classification Search
USPC ..... 220/608, 609, 623, 624
See application file for complete search history.

(56) References Cited

U.S. PATENT DOCUMENTS

| | | | | |
|---|---|---|---|---|
| 3,409,167 | A | | 11/1968 | Blanchard |
| 3,942,673 | A | | 3/1976 | Lyu et al. |
| 4,125,632 | A | | 11/1978 | Vosti et al. |
| 4,174,782 | A | | 11/1979 | Obsomer |
| 4,231,483 | A | | 11/1980 | Dechenne et al. |
| 4,318,882 | A | * | 3/1982 | Agrawal et al. ..... 264/521 |
| 4,342,398 | A | | 8/1982 | Chang |
| 4,381,061 | A | | 4/1983 | Cerny et al. |
| 4,408,698 | A | | 10/1983 | Ballester |
| 4,431,112 | A | | 2/1984 | Yamaguchi |
| 4,542,029 | A | | 9/1985 | Caner et al. |
| 4,620,639 | A | | 11/1986 | Yoshino |
| 4,667,454 | A | | 5/1987 | McHenry et al. |
| 4,863,046 | A | | 9/1989 | Collette et al. |
| 4,880,129 | A | | 11/1989 | McHenry et al. |
| 5,005,716 | A | | 4/1991 | Eberle |
| 5,054,632 | A | | 10/1991 | Alberghini et al. |
| 5,092,475 | A | | 3/1992 | Krishnakumar et al. |
| 5,141,120 | A | | 8/1992 | Brown et al. |

(Continued)

FOREIGN PATENT DOCUMENTS

| | | |
|---|---|---|
| CN | 1822989 A | 8/2006 |
| EP | 0879765 | 11/1998 |

(Continued)

OTHER PUBLICATIONS

Office Action from the Chinese Patent Office in the corresponding Application No. 200980111121.0.

(Continued)

*Primary Examiner* — Anthony Stashick
*Assistant Examiner* — Kevin Castillo
(74) *Attorney, Agent, or Firm* — Greer, Burns & Crain, Ltd.

(57) ABSTRACT

A plastic container is provided having a container body and a closed base. The base includes a base body and a plurality of deflection ribs configured to buckle as the base deforms in response to an increase in negative pressure internal to the container.

12 Claims, 25 Drawing Sheets

(56) References Cited

U.S. PATENT DOCUMENTS

| | | | | |
|---|---|---|---|---|
| 5,178,289 | A | 1/1993 | Krishnakumar et al. | |
| 5,217,737 | A | 6/1993 | Gygax et al. | |
| 5,234,126 | A | 8/1993 | Jonas et al. | |
| 5,492,245 | A | 2/1996 | Kalkanis | |
| RE36,639 | E | 4/2000 | Okhai | |
| 6,176,382 | B1 | 1/2001 | Bazlur Rashid | |
| 6,299,007 | B1 | 10/2001 | Takeuchi | |
| 6,595,380 | B2 | 7/2003 | Silvers | |
| 6,612,451 | B2 | 9/2003 | Tobias et al. | |
| 6,857,531 | B2 | 2/2005 | Slat et al. | |
| 6,942,116 | B2 | 9/2005 | Lisch et al. | |
| 6,983,858 | B2 | 1/2006 | Slat et al. | |
| 7,150,372 | B2 | 12/2006 | Lisch et al. | |
| 7,287,658 | B1 | 10/2007 | Johnson et al. | |
| 7,451,886 | B2 | 11/2008 | Lisch et al. | |
| 7,543,713 | B2 * | 6/2009 | Trude et al. | 215/373 |
| 2002/0153343 | A1 | 10/2002 | Tobias et al. | |
| 2003/0196926 | A1 | 10/2003 | Tobias et al. | |
| 2004/0211746 | A1 | 10/2004 | Trude | |
| 2004/0232103 | A1 | 11/2004 | Lisch et al. | |
| 2006/0006133 | A1 | 1/2006 | Lisch et al. | |
| 2009/0159556 | A1 | 6/2009 | Patcheak et al. | |
| 2010/0219152 | A1 | 9/2010 | Derrien et al. | |

FOREIGN PATENT DOCUMENTS

| | | |
|---|---|---|
| JP | 62-146137 | 6/1987 |
| JP | 08-104313 | 4/1996 |
| JP | 10-181734 | 7/1998 |
| JP | 10181734 | 7/1998 |
| JP | 2000-128140 | 5/2000 |
| WO | 2004/028910 | 4/2004 |
| WO | WO 2004/028910 | 4/2004 |
| WO | 2006/062829 | 6/2006 |
| WO | 2006/118584 | 11/2006 |

OTHER PUBLICATIONS

Translation of Office Action in co-pending Japanese Patent Application No. 2011-502106.

* cited by examiner

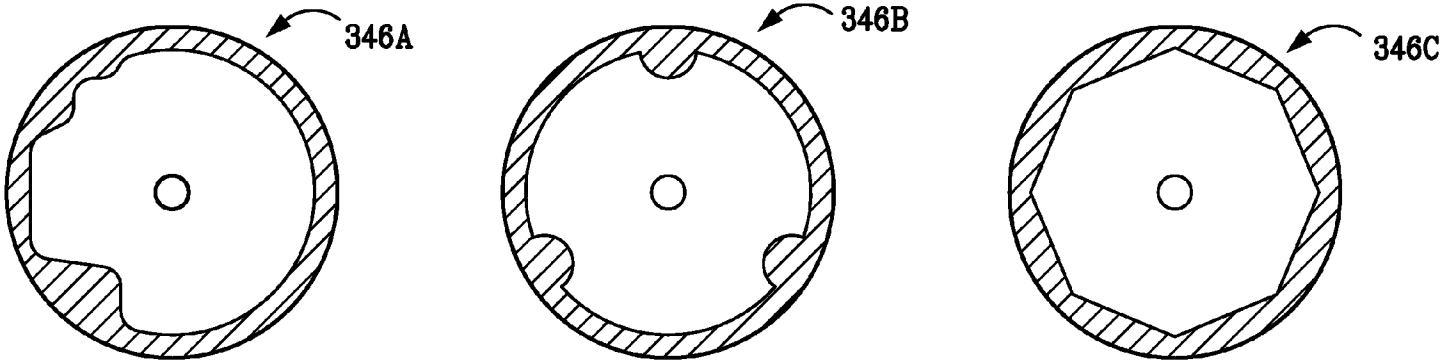
FIG. 32A
FIG. 32B
FIG. 32C
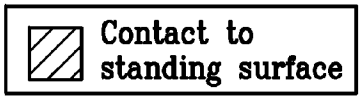
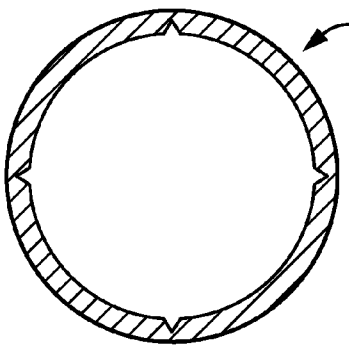
FIG. 32D
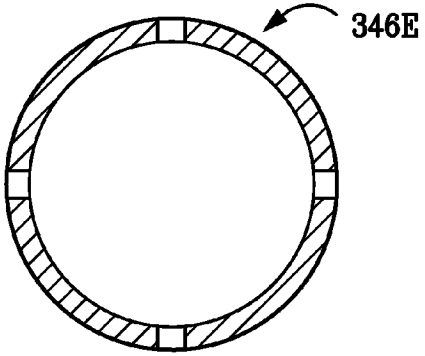
FIG. 32E
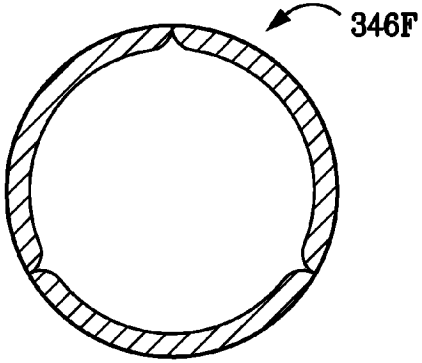
FIG. 32F

CONTAINER BASE HAVING VOLUME ABSORPTION PANEL

CROSS REFERENCE TO RELATED APPLICATIONS

This application claims the benefit of U.S. Patent Application No. 61/040,067, filed on Mar. 27, 2008, the disclosure of which is hereby incorporated by reference as if set forth in its entirety herein.

BACKGROUND

This disclosure relates to containers, and more particularly to containers that experience negative internal pressure after being filled, sealed, and capped.

It has been a goal of conventional container design to form container bodies that have a desired and predictable shape after filling and at the point of sale. For example, it is often desired to produce containers that maintain an approximately cylindrical body or a circular transverse cross section. However, in some instances, the containers are susceptible to negative internal pressure (that is, relative to ambient pressure), which causes the containers to deform and lose rigidity and stability, and results in an overall unaesthetic appearance. Several factors can contribute to the buildup of negative pressure inside the container.

For instance, in a conventional hot-fill process, the liquid or flowable product is charged into a container at elevated temperatures, such as 180 to 190 degrees F., under approximately atmospheric pressure. Because a cap hermetically seals the product within the container while the product is at the hot-filling temperature, hot-fill plastic containers are subject to negative internal pressure upon cooling and contraction of the products and any entrapped air in the head-space. The phrase hot filling as used in the description encompasses filling a container with a product at an elevated temperature, capping or sealing the container, and allowing the package to cool.

As another example, plastic containers are also often made from materials such as polyethylene terephthalate (PET) that can be susceptible to the egress of moisture over time. Biopolymers or biodegradable polymers, such as polyhydroxyalkanoate (PHA) also exacerbate egress issues. Accordingly, moisture can permeate through container walls over the shelf life of the container, which can cause negative pressure to accumulate inside the container. Thus, both hot-fill and cold-fill containers are susceptible to the accumulation of negative pressure capable of deforming conventional cylindrical container bodies.

Conventional containers include designated flexing portions, or vacuum panels, that deform when subjected to typical negative internal pressures resulting from the hot filling process. The inward deflection of the vacuum panels tends to equalize the pressure differential between the interior and exterior of the container to enhance the ability of the cylindrical sections to maintain an attractive shape, to enhance the ease of labeling, or to provide like benefit.

Some container designs are symmetric about a longitudinal centerline and designed with stiffeners to maintain the intended cylindrical shape while the vacuum panels deflect. For example, U.S. Pat. Nos. 5,178,289; 5,092,475; and 5,054,632 teach stiffening portions or ribs to increase hoop stiffness and eliminate bulges while integral vacuum panels collapse inwardly. U.S. Pat. No. 4,863,046 is designed to provide volumetric shrinkage of less than one percent in hot-fill applications.

Other containers include a pair of vacuum panels, each of which has an indentation or grip portion enabling the container to be gripped between a user's thumb and fingers. For example, U.S. Pat. No. 5,141,120 teaches a bottle having a hinge continuously surrounding a vacuum panel, which includes indentations for gripping. The hinge enables the entire vacuum panel to collapse inwardly in response to negative internal pressure.

What is desirable is a container capable of deflecting at an inconspicuous location in response to the accumulation of negative internal pressure.

SUMMARY

In accordance with one embodiment, a plastic container is configured to absorb negative internal pressure. The plastic container includes a substantially cylindrical container body defining an upper portion that extends upwardly to a finish, and an opposing lower portion. The plastic container further includes an enclosed base connected to the lower portion of the substantially cylindrical container body. The base includes a standing member configured to rest on a support surface, a substantially centrally disposed hub disposed radially inward from the standing member, and a base body extending between the standing member and the central hub. The base body includes at least one deflection rib configured to buckle in response to a threshold level of negative internal pressure. The base body can deform from an as-molded state to a deformed state in response to an increase in negative internal pressure. Further deformation of the base body in response to further increased negative internal pressure causes the rib to buckle, thereby allowing the base body to further deform from the deformed state to a deflected state.

BRIEF DESCRIPTION OF THE DRAWINGS

FIG. 32 A-F are schematic section views of the base illustrated in FIG. 23 having a standing member or chime constructed in accordance with various alternative embodiments.

DETAILED DESCRIPTION

Figure 1:
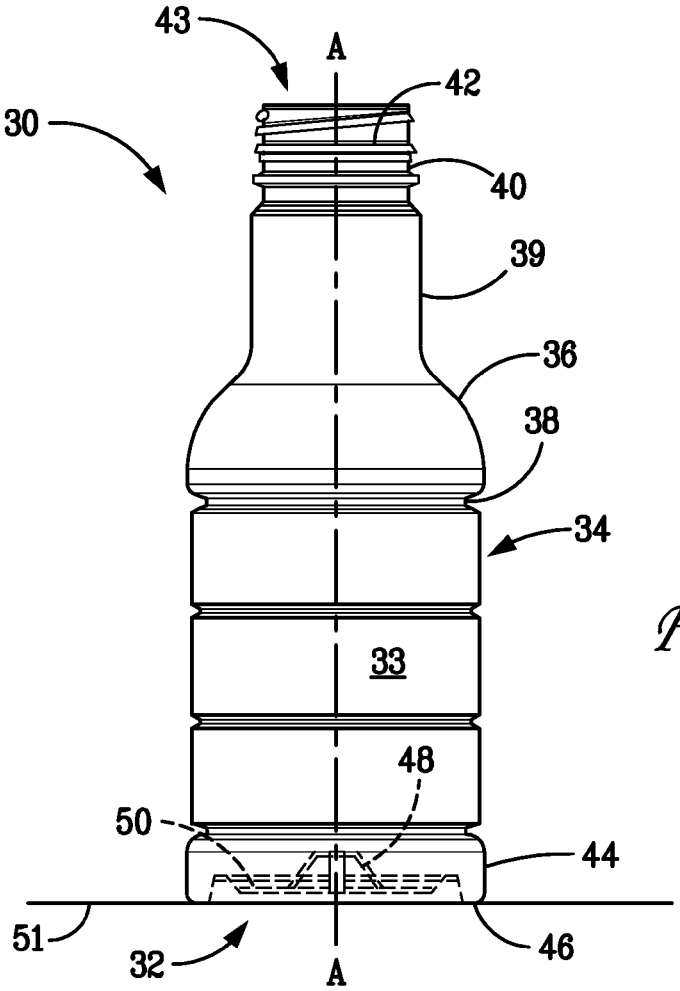
FIG. 1 is a side elevation view of a container constructed in accordance with one embodiment.
Figure 2:
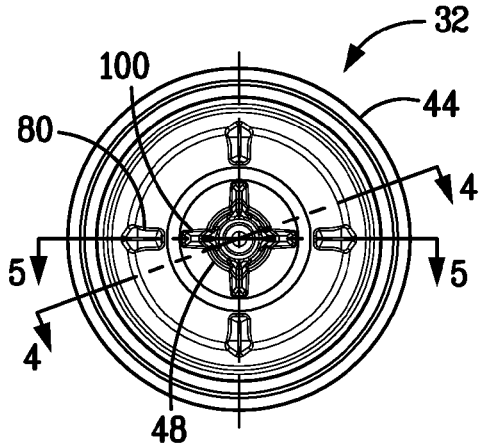
FIG. 2 is a bottom plan view of a container of the type illustrated in FIG. 1 showing a plurality of circumferentially spaced deflection ribs.

Referring to FIG. 1, a container 30 constructed in accordance with one embodiment can be cylindrical and extend axially along axis A-A. The container 30 can include a substantially cylindrical body 34 that includes grooves 38 that provide a gripping surface configured, for instance, to be engaged between a user's thumb and fingers. The body 34 has an upper portion such as dome 36 extending up that can narrow along a neck 39 to a finish 40. The finish 40 can have threads 42 configured to engage mating threads on a closure member such as a conventional cap that covers a pour opening 43. The substantially cylindrical body 34 can include define a lower end that is closed by a base 32. The container 30 can be a hot-fill pressure-responsive container or a cold-fill pressure-responsive container, and can define an interior void 33 that defines an internal volume configured to retain a liquid product (not shown).

It should be appreciated that the container 30 illustrated is presented by way of example, and that any container structure is contemplated. The container 30 can be fabricated using any method and material appreciated by one having ordinary skill in the art. In one embodiment, the container 30 can be formed from a blow molded plastic, such as polyethylene terephthalate (PET), polyenthylene napthalate (PEN), combination of the two, or any suitable alternative or additional materials.

The base 32 can include an annular heel 44 connected to the lower end of the body 34, an annular chime or standing ring 46 (which can be a standing member of any geometric shape not necessarily limited to a ring shape, but referred to as a ring for the purposes of illustrated) extending down from the heel 44, and a raised and generally concave reentrant portion or hub 48 that is substantially centrally disposed on the base 32. The standing ring 46 is configured to rest on a support surface 51. It should be appreciated that the terms "concave" and "convex" used herein with reference to a radial direction of extension, unless otherwise specified, and in relation to a view of the base 32 taken from outside the container 30, such as a bottom plan view of the container 30, for instance from the support surface 51.

The container 30 is oriented in FIG. 1 such that the container 30 extends vertically, or axially, along an axis A-A, and radially along a horizontal direction that is perpendicular with respect to the vertical direction, it being appreciated that the actual orientations of the container 30 may vary during use. Accordingly, the directional terms "vertical" and "horizontal" are used to describe the container 30 and its components with respect to the orientation illustrated in FIG. 1 merely for the purposes of clarity and illustration. Thus, the directional term "vertical" and its derivatives are used with reference to a direction along axis A-A, with the upward direction being in a direction from the base 32 toward the pour opening 43, and the downward direction being in a direction from the pour opening 43 toward the base 32.

A concave surface can thus be described as including an outer radial end, a radially inner end, and a middle portion disposed between the radial ends that is disposed at a vertical position spaced above at least one or both of the radial ends. A convex surface includes an outer radial end, a radially inner end, and a middle portion disposed between the radial ends, wherein the middle portion is disposed below at least one or both of the radial ends.

The directional terms "inboard" and "inner," "outboard" and "outer," and derivatives thereof are used herein with respect to a given apparatus to refer to directions along the directional component toward and away from the geometric center of the apparatus. While the various components of the base are described as being annular unless otherwise specified, it should be appreciated that different container geometries may include varying base geometries such that the base structure need not be annular or circumferential as described, but can be discontinuous or interrupted by additional structure. Furthermore, the structure of the base 32 can extend along Cartesian directions (e.g., lateral and longitudinal) along a base of a container as opposed to radial and axial directions as illustrated herein.

The base 32 further includes one or more deflection ribs 50 schematically illustrated in FIG. 1 that can extend radially between the standing ring and the hub 48. It should be appreciated that the deflection ribs 50 provide internal pressure deflection zones that are configured to buckle, thereby allowing the base to achieve a deflected state that reduces the internal volume of the container 30 to compensate for an accumulation (or increase) of negative internal pressure within the container that can result from the hot filling process and/or moisture egress over time. Several example embodiments of the base 32 will now be described, it being appreciated that the embodiments are presented by way of illustration, and are not intended to limit the scope of the present invention.

Referring now to FIGS. 2-5, the general structure of the base 32 can include the standing ring 46, an annular raised ring 52 disposed radially inward with respect to the standing ring 46, an annular medial ring 54 disposed radially inward with respect to the raised ring 52, and an annular sloped hub interface wall 56 that joins the medial ring 54 to the hub 48. The radially outer end of the medial ring 54 can define a radius that is greater than that of the standing ring 46, which in turn is greater than that of the raised ring 52.

The standing ring 46 can include a curved convex bottom wall 58 connected at its outer radial end to the heel 44, and connected at its radially inner end to an upstanding wall 60 that can extend substantially vertically above (and can also extend slightly radially inwardly from) the convex bottom wall 58. The upstanding wall 60 thus defines the radially inner end of the standing ring 46. The upstanding wall 60 can also define the radially outer end of the raised ring 52, which is disposed radially inward with respect to the standing ring 46. The raised ring 52 can include a curved and concave upper wall 62 and a sloped radial wall 64 connected to the radially inner end of the curved upper wall 62. The radial wall 64 can extend vertically down and radially inward from the upper wall 62.

It should be appreciated that the terms "sloped" and "curved" are used herein to describe surfaces or walls that extend along an angle and include a curvature, respectively, when viewed in vertical cross section taken through the center of the base. It should further be appreciated, however, that "sloped" and "curved" walls or surfaces need not be purely sloped or purely curved, and that modifications could be made to the geometries of the surfaces and walls described herein without departing from the spirit and scope of the present invention.

The sloped radial wall 64 can extend down to a curved convex outer medial wall 66 that defines a lowest point vertically offset from (above) the lowest point of the bottom wall 58 of the standing ring 46. The outer medial wall 66 is joined at its radially inner end to the medial ring 54, which is concave and radially elongate. The radially inner end of the medial ring 54 is connected to a curved and convex inner medial wall 68. The inner medial wall 68 can define a lowest point that is vertically offset from (above) the lowest point of the outer medial wall 66.

The radially inner end of the inner medial wall 68 is connected to the sloped hub interface wall 56, which extends vertically above and radially in from the inner medial wall 68. The hub interface wall 56 can extend substantially linearly, or can define a slight concave or convex curvature. The upper and radially inner end of the hub interface wall 56 can terminate at a vertical position above the raised ring 52, and can connect to a raised concave hub base 70.

The concave hub base 70 connects at its radially inner end to a convex outer hub perimeter 72 whose radially inner end is disposed vertically above and radially inward with respect to the radially inner end of the hub base 70. The radially inner end of the outer hub perimeter 72 is connected to the radially outer end of an inner hub perimeter 74. The inner hub perimeter 74 is concave and defines an upper portion 75 that is disposed at a vertical position spaced above the radially inner end of the outer hub perimeter 72. The radially inner end of the inner hub perimeter 74 is attached to a convex depression 76 that extends below the inner hub perimeter 74.

Figure 3:
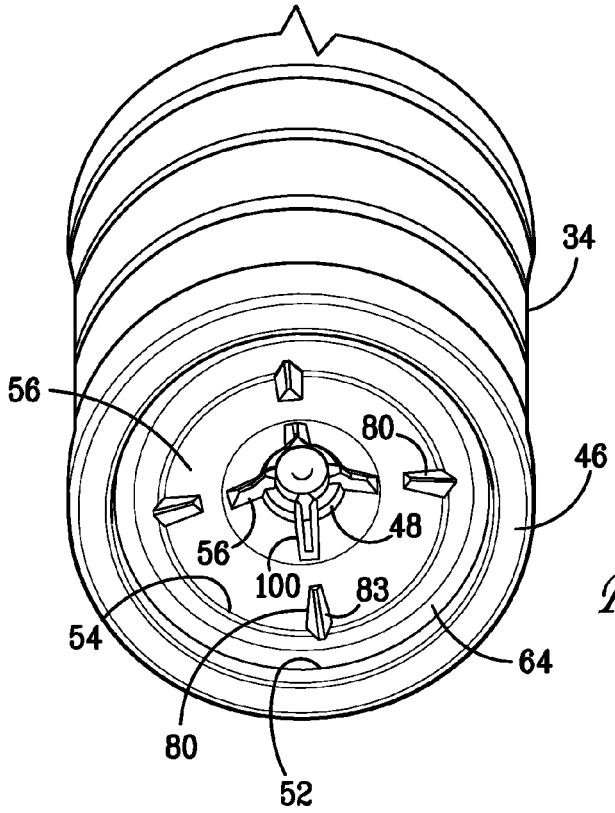
FIG. 3 is a perspective view of the base illustrated in FIG. 2 in its as-molded, or undeformed, state.
Figure 4:
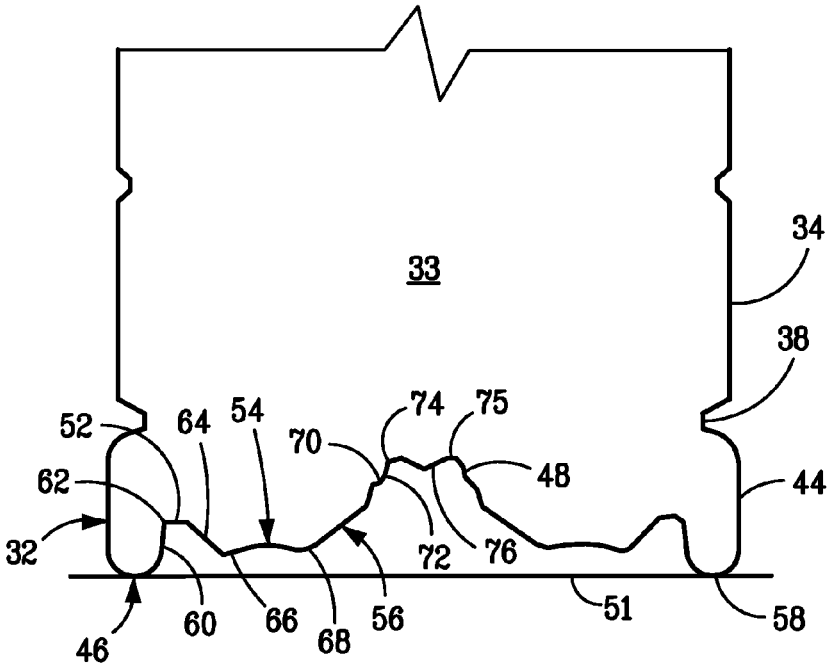
FIG. 4 is a sectional side elevation view of the base illustrated in FIG. 2 taken along line 4-4 through the deflection ribs, showing the container in its as-molded, or undeformed, state.
Figure 5:
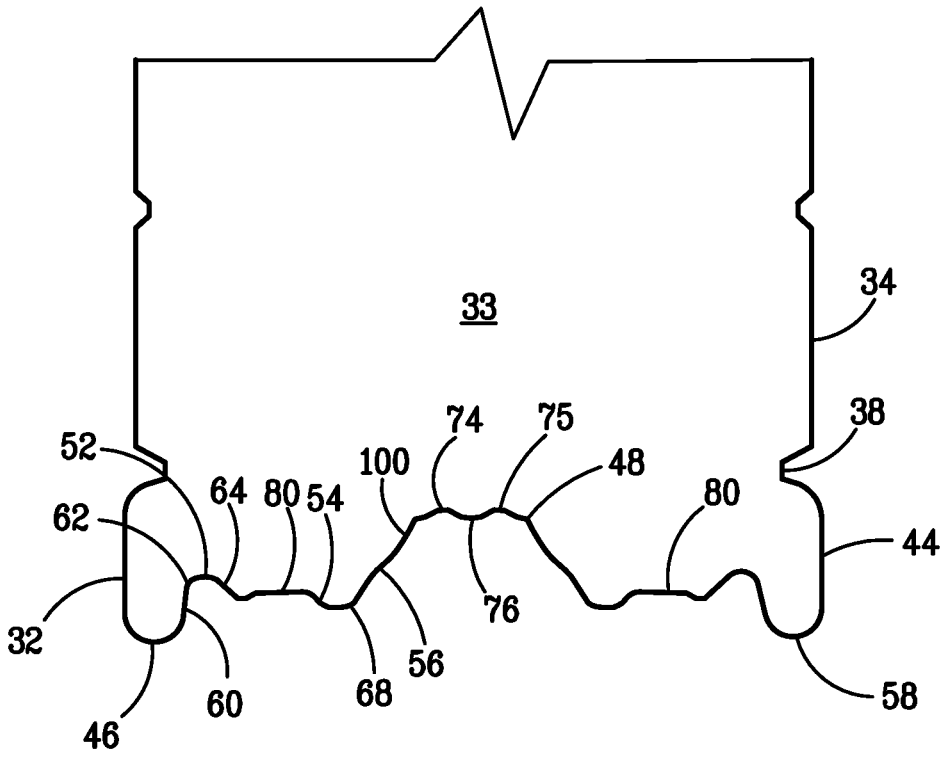
FIG. 5 is a sectional side elevation view of the base illustrated in FIG. 2 taken along line 5-5 outside of the deflection ribs, showing the container in its as-molded state, or undeformed, state.
Figure 6:
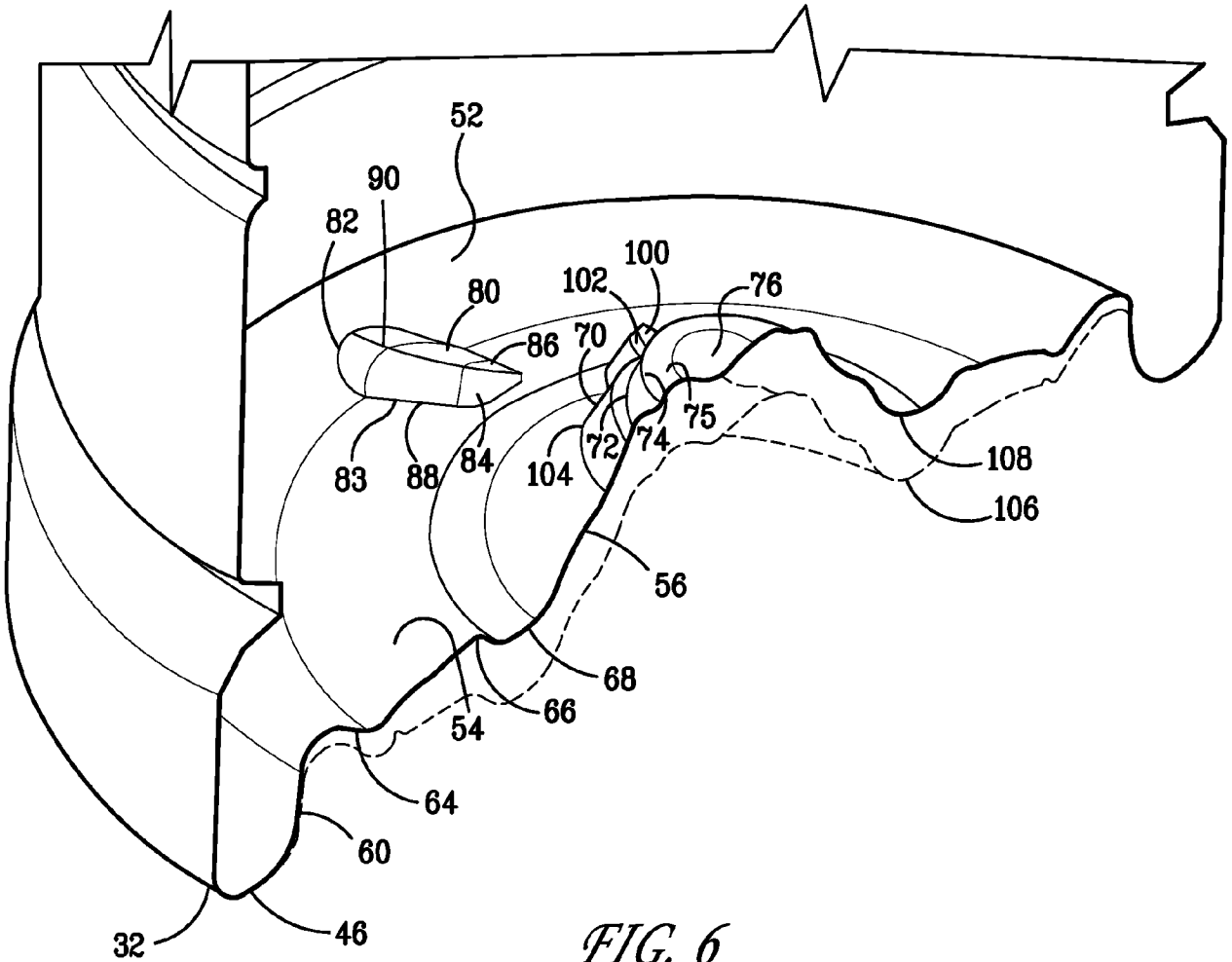
FIG. 6 is a sectional perspective view of a section of base illustrated in FIG. 2, showing the base in a deformed but undeflected state.

Referring now also to FIGS. 5-6, the base 32 further includes one or more deflection ribs 80 that can be spaced circumferentially about the base. Each rib 80 is not circumferentially continuous about the base, and thus defines an enclosed outer perimeter 83 having opposing outer circumferential boundaries (FIG. 3). The ribs 80 can be equally spaced circumferentially about the base 32. In the illustrated embodiment, four ribs 80 are shown spaced approximately 90° circumferentially from each other, though alternative embodiments can include any desired number of ribs spaced equidistantly about the base or at different spatial intervals.

Each rib 80 can be radially elongate, and can extend between the standing ring 46 and the hub 48. Broadly stated, each rib 80 can be connected between two or more (e.g., at least a pair of) differently sloped surfaces of the base. For instance, each rib can extend between the raised ring 52 and the hub interface wall 56. More particularly still, each rib 80 can terminate at a radially outer end 82 that is connected to the raised ring 52, and can further terminate at its radially inner end 84 which is connected to the medial ring 54. Each rib can thus be said to extend between, and be connected between, the raised ring 52 and the medial ring 54. Specifically, the radially outer end 82 of each rib 80 can be connected to the sloped radial wall 64 of the raised ring 52, and the radially inner end 84 of each rib 80 can be connected to the radially outer end of the medial ring 54 at a location proximate to the inner medial wall 68.

Referring now also to FIG. 6, each rib 80 can and extend vertically above the surrounding base structure, and can be circumferentially convex and define a circumferential middle portion 86 spaced above a pair of circumferential end portions 88 that are attached to the surrounding base 32. The middle portion 86 and end portions 88 can define a substantially triangular cross section (that is, taken transverse to a radial line defined by the base). Furthermore, the radially outer end 82 can define a circumferential thickness greater than the circumferential thickness of the radially inner end 84. Alternatively, the circumferential thickness of the radially outer end 82 could be substantially equal to, or less than, the circumferential thickness of the radially inner end 84.

The base 32 further includes one or more strengthening ribs 100 radially aligned with the deflection ribs 80. Each strengthening rib 100 can extend between the hub 48 and the aligned deflection rib 80. In particular, each strengthening rib 100 can define a radially inner end 102 that is connected to the outer hub perimeter 72, and a radially outer end 104 that is connected to the hub interface wall 56. The strengthening ribs 100 can further define circumferentially outer boundaries, and can thus define an enclosed perimeter. The strengthening ribs 100 can transfer forces imparted onto the base due to negative internal pressure radially outward towards the deflection ribs 80.

Figure 7:
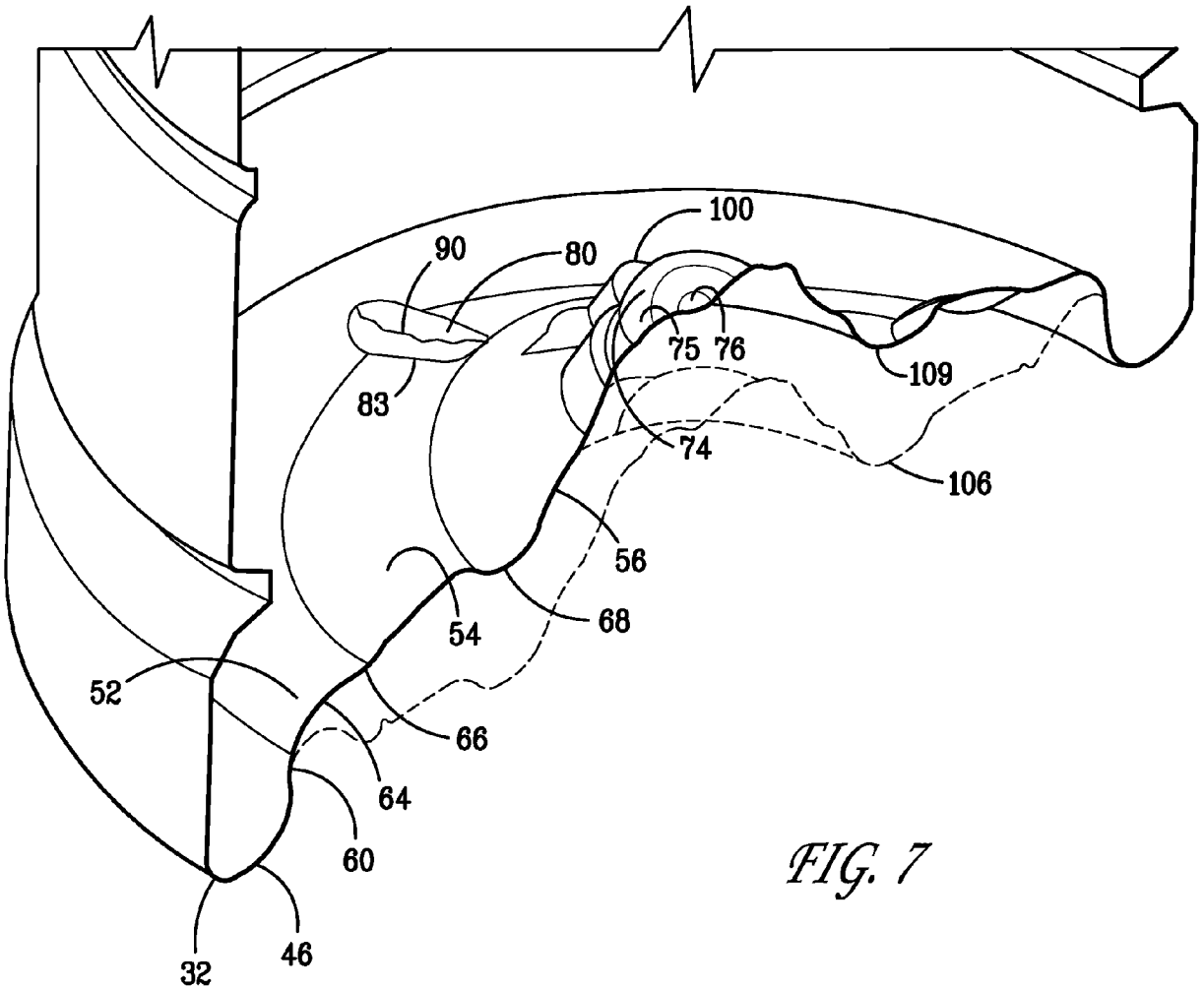
FIG. 7 is a sectional perspective view of the base illustrated in FIG. 6, showing the base in a deflected state.

Accordingly, referring now also to FIGS. 6-7, each rib 80 can create a deflection location 90 on the base 32, preferably within the structure of the rib 80 itself, that is configured to buckle upon a predetermined amount of displacement of the base in response to negative internal pressure accumulation.

As illustrated, each deflection location 90 can be disposed at the interface between the radially outer end 82 of the corresponding rib 80 and the sloped radial wall 64. Each rib 80 can transfer forces, such that the deflection location 90 can include portions of the radially outer end 82 of the rib 80 and the raised ring 52, or can alternatively include portions of the raised ring 52 and not the radially outer end 82, or alternatively still can include portions of the radially outer end 82 and not the raised ring 52. Portions of the raised ring 52 that can buckle include the upstanding wall 60, the curved upper wall 62, and the sloped radial wall 64. The deflection location 90 can alternatively or additionally include any and all portions of the rib 80.

FIG. 6 illustrates a phantomed profile of the base 32 in its as-molded state, or undeformed state 106. FIG. 6 further illustrates a profile 108 of the base 32 that has deformed to a deformed state in response to negative internal pressure, which causes the ribs 80 to bend. Stress concentrations disposed at the deflection locations 90 increase as the base 32 increasingly deforms due to the accumulation of negative internal pressure.

As shown in FIG. 7, once the negative internal pressure increases to a threshold level, the base body deformation causes the stress concentrations to increase to a level, which without being bound by theory is believed to be the yield point of the base material (such as PET), which in turn causes the deflection location 90 to deflect, or buckle, thereby allowing the base 32 to further deform to a deflected state 109 in response to additional negative internal pressure.

Figure 8:
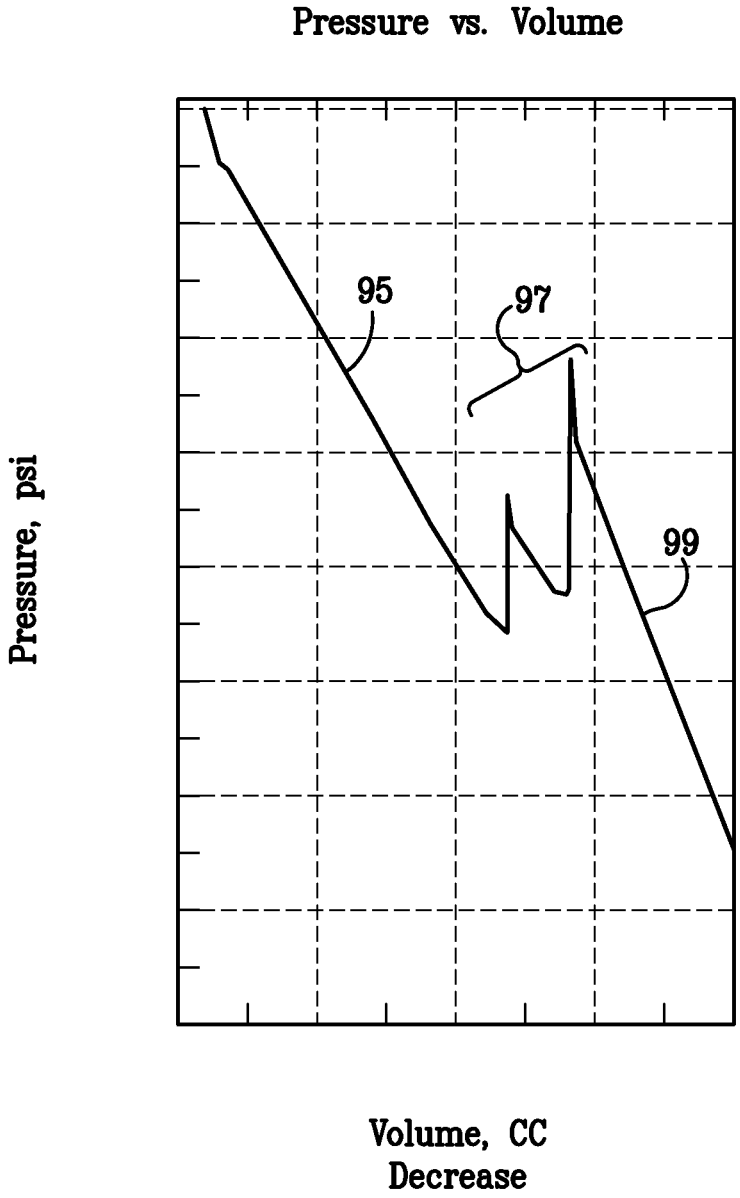
FIG. 8 is a graph plotting decrease in internal volume as a function of. increasing negative internal pressure of a container having a base as illustrated in FIGS. 2-7.

Referring also to FIG. 8, the decrease in container volume (CC) on the x-axis is plotted as a function of the increasing negative internal pressure on the y-axis. Each tick along the x-axis corresponds to 2.5 CC, such that the internal container volume decreases in a positive direction from the origin along the x-axis. Each tick along the y-axis corresponds to 0.25 psi, such that the magnitude of negative internal pressure decreases in a positive direction from the origin along the y-axis.

As the deflection location 90 buckles, the base 32 further deforms in response to increasing negative internal pressure at a rate greater than the rate of base deformation with respect to the negative internal pressure prior to buckling. Accordingly, as negative pressure begins to accumulate within the container, the base 32 begins to deform during a first deformation phase 95 which causes the container volume to decrease substantially linearly relative to the negative pressure increase. As the negative pressure continues to increase in magnitude, one or more of the deflection location 90 buckles, at a second deformation, or deflection, phase 97, which causes the internal volume of the container to decrease as a function of increasing negative internal pressure at a rate greater than the rate of volume decrease as a function of negative internal pressure prior to buckling. As a result, the negative pressure dissipates in immediate response to buckling. If the negative pressure increase continues after buckling, the base 32 can deform during a third deformation phase 99 which causes the container volume to decrease substantially linearly relative to the negative pressure increase until the base 32 achieves its deflected state.

It should be appreciated that the first and third deformations phase 95 and 99 include gradual base deformation. The second deformation phase, or deflection phase 97, is reflected in a sharp change in slope of the pressure vs. volume curve, even approaching a discontinuity of the curve.

It should be appreciated that the actual negative internal pressures and container volume decreases associated with the first, second, and third deformation phases can vary based on various factors, for instance the base geometry, including material thickness, size of the base and its components, placement of the various components of the base, and the like. In the illustrated embodiment, the rib 80 is configured to buckle prior to any deflection or substantial deformation of the cylindrical body 34 of the container 30.

Depending on the amplitude of the negative internal pressure and the nature of the radial symmetry of the geometry of the base 32, one or more of the deflection locations 90 may buckle before others, and one or more deflection locations 90 may not buckle altogether in a particular negative internal pressure situation.

It should be appreciated that the deflection location 90 can have a first stiffness prior to buckling, and a second stiffness after buckling that is less than the first stiffness. In accordance with one embodiment, once the negative internal pressure dissipates, for instance upon removal of the cap or other closure, the base 32 can return substantially to its as-molded, or undeformed, state.

It should be further appreciated that the base 32 has been illustrated in accordance with one embodiment, and that the present invention is not intended to be limited to the particular geometry descried with reference to FIGS. 2-8 or the alternative embodiments described herein. One such alternative embodiment of the base 32 will now be described with reference to FIGS. 9-15.

Figure 10:
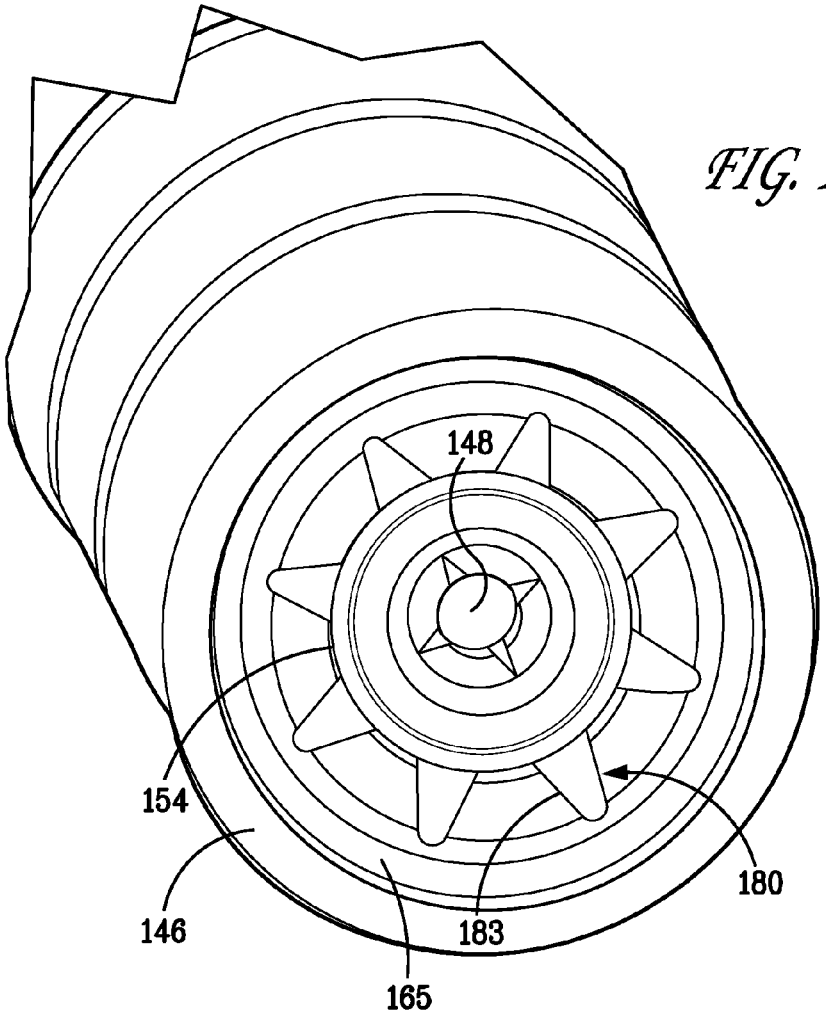
FIG. 10 is a perspective view of the base illustrated in FIG. 9 in its as-molded, or undeformed, state.
Figure 9:
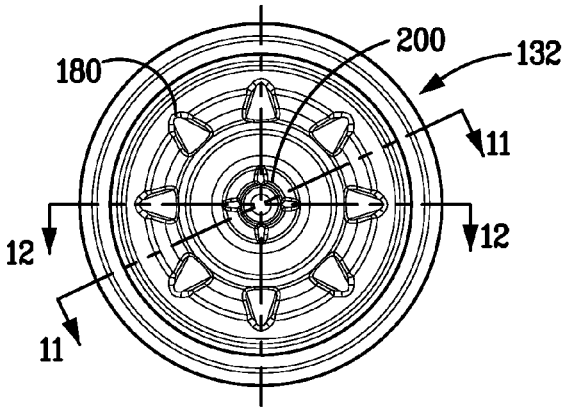
FIG. 9 is a bottom plan of a container of the type illustrated in FIG. 1, with the base constructed in accordance with an alternative embodiment and including a plurality of circumferentially spaced deflection ribs.
Figure 11:
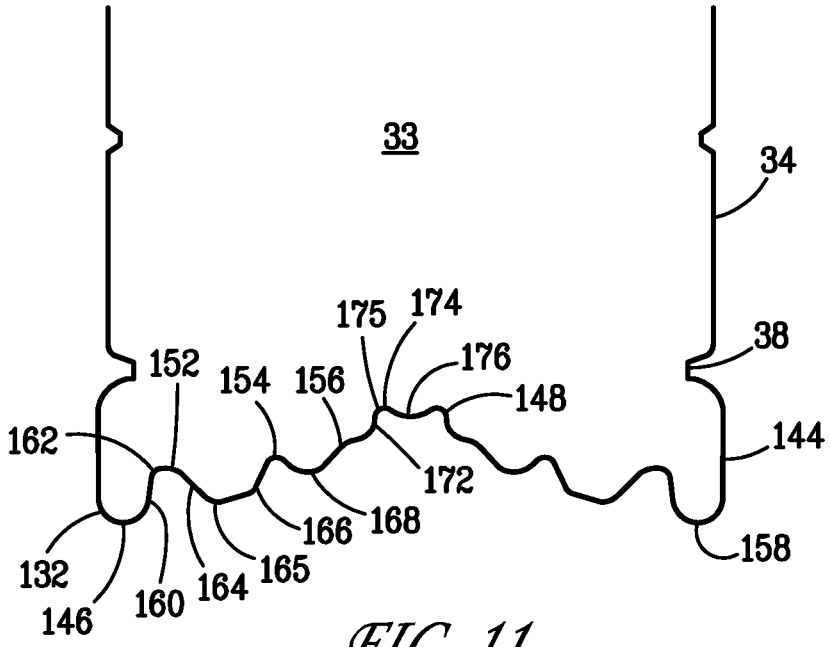
FIG. 11 is a sectional side elevation view of the base illustrated in FIG. 9, taken along line 11-11 through the deflection ribs, showing the container in its as-molded, or undeformed, state.

Referring particularly to FIGS. 9-11, a base 132 constructed in accordance with an alternative embodiment is illustrated, whereby reference numerals of elements of the base 132 that correspond to like elements of the base 32 have been incremented by 100 for the purposes of clarity and illustration. It should be understood that the elements having reference numerals increased by 100 need not identify structure that is identical to the corresponding structure of the base 32.

The base 132 can include an annular heel 144 a standing ring 146 extending down from the heel 144, and a raised and generally concave reentrant portion or hub 148 that is substantially centrally disposed on the base 132. The base standing ring 146 is configured to rest on a support surface 151.

The general structure of the base 132 can include the standing ring 146, an annular raised ring 152 disposed radially inward with respect to the standing ring 146, an annular medial ring 154 disposed radially inward with respect to the raised ring 152 and a hub interface wall 156 that joins the medial ring 154 to the hub 148.

Specifically, the standing ring 146 includes a curved convex bottom wall 158 connected at its radially outer end to the heel 144, and connected at its radially inner end to an upstanding wall 160 that can extend substantially vertically above (and can also extend slightly radially inwardly from) the convex bottom wall 158. The upstanding wall 160 can define the radially inner end of the standing ring 146. The upstanding wall 160 can also define the radially outer end of the raised ring 152, which is disposed radially inward with respect to the standing ring 146. The raised ring 152 can include a curved and concave upper wall 162 and a sloped radial wall 164 connected to the radially inner end of the upper wall 162. The radial wall 164 can extend vertically down and radially inward from the curved upper wall 162.

The sloped radial wall 164 can extend down to a curved convex ring interface portion 165 that defines a lowest point vertically offset (above) the lowest point of the bottom wall 158 of the standing ring 146. The ring interface portion 165 extends radially inwardly and up to a convex outer medial wall 166 that defines a lowest point spaced vertically above the lowest point of the ring interface portion 165. The outer medial wall 166 is joined at its radially inner end to the medial ring 154, which is concave and radially elongate. The medial ring 154 defines an uppermost point that is disposed vertically above the highest point of the raised ring 152.

The radially inner end of the medial ring 154 is connected to a curved and convex inner medial wall 168. The inner medial wall 168 can define a lowest point that is vertically offset from (above) the lowest point of the outer medial wall 166.

The radially inner end of the inner medial wall 168 is connected to the hub interface wall 156, which is concave and extends above and radially in from the inner medial wall 168. The hub interface wall 156 can further define a concave curvature. The upper and radially inner end of the hub interface wall 156 can terminate at a vertical position above the medial ring 154, and can connect to a convex outer hub perimeter 172. The radially inner end of the outer hub perimeter 172 is connected to the radially inner end of an inner hub perimeter 174. The inner hub perimeter 174 is concave and defines an upper portion 175 that is disposed at a vertical position spaced above the radially inner end of the outer hub perimeter 172. The radially inner end of the inner hub perimeter 174 is attached to a convex depression 176 that is extends below the inner hub perimeter 174.

Figure 12:
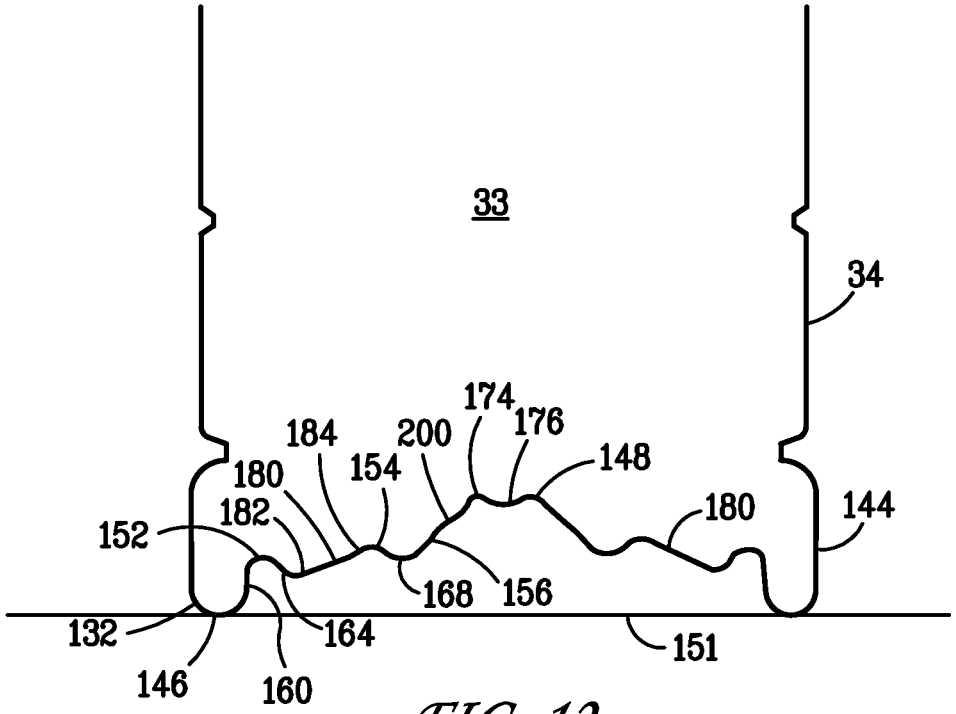
FIG. 12 is a sectional side elevation view of the base illustrated in FIG. 9 taken along line 12-12 outside the deflection ribs, showing the container in its as-molded state, or undeformed, state.

Referring now also to FIG. 12, the base 132 further includes deflection ribs 180 that can be spaced circumferentially about the base. Each rib 180 is not circumferentially continuous, and thus defines an enclosed outer perimeter 183 having opposing outer circumferential boundaries (FIG. 9). The ribs 180 can be equally spaced circumferentially about the base 132. In the illustrated embodiment, eight ribs 180 are shown spaced approximately 45° circumferentially from each other.

Figure 13:
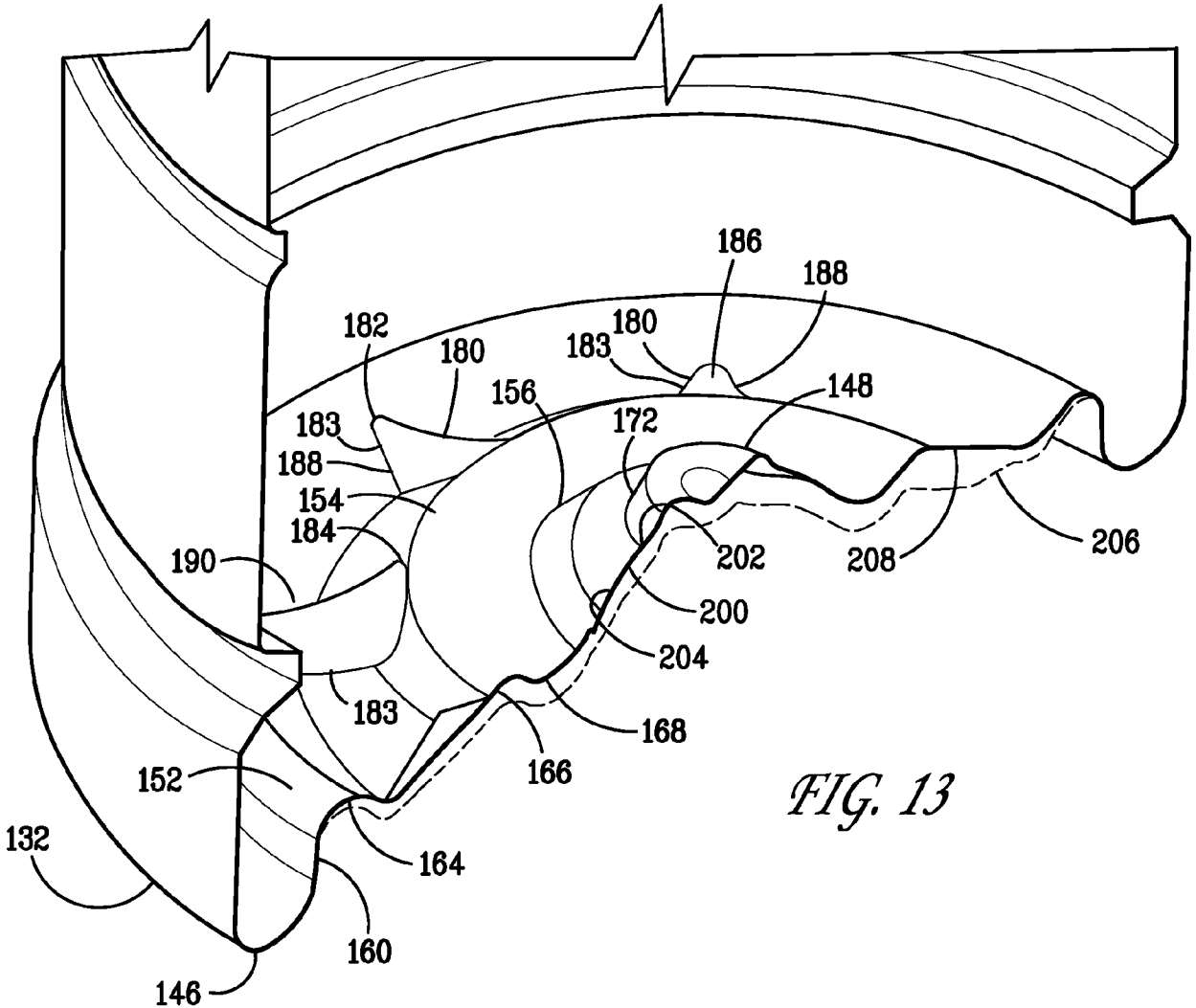
FIG. 13 is a sectional perspective view of the base illustrated in FIG. 9, showing the base in a deformed but undeflected state.

Referring also to FIG. 13, each rib 180 can be radially elongate, and can extend between the standing ring 146 and the hub 148. Broadly stated, each rib 180 can be connected between two or more (e.g., at least a pair of) differently sloped surfaces of the base. More particularly, each rib can extend between the raised ring 152 and the hub interface wall 156. More particularly still, each rib 180 can extend between the raised ring 152 and the medial ring 154. In the illustrated embodiment, each rib 180 can terminate at a radially outer end 182 that is connected to the raised ring 152, and can further terminate at its radially inner end 184 which is connected to the medial ring 154. The radially outer end 182 of the rib 180 can be disposed at a height lower than the radially inner end 184 of the rib (see FIG. 12).

Each rib 180 can thus be said to extend between, and be connected between, the raised ring 152 and the medial ring 154. Specifically, the radially outer end 182 of each rib 180 can be connected to the sloped radial wall 164, and the radially inner end 184 of each rib 180 can be connected to the radially inner end of the medial ring 154 at a location proximate to the outer medial wall 166.

Referring now also to FIG. 13, each rib 180 can extend up from the surrounding base structure, and can define a circumferential middle portion 186 spaced above a pair of circumferential end portions 188 that are attached to the surrounding base 132. The middle portion 186 and end portions 188 can define a substantially triangular cross section (that is, taken transverse to a radial line defined by the base). Furthermore, the radially outer end 182 can define a circumferential width that is less than the circumferential thickness of the radially inner end 184. Alternatively, the circumferential thickness of the radially outer end 182 could be substantially equal to, or greater than, the circumferential thickness of the radially inner end 184.

The base 132 further includes one or more strengthening ribs 200 radially aligned with the deflection ribs 180. As illustrated, four strengthening ribs 200 are spaced 90° circumferentially from each other, and the strengthening ribs 200 are thus aligned with alternating deflection ribs 180. Each strengthening rib 200 can extend between the hub 148 and the aligned deflection rib 180. In particular, each strengthening rib 200 can define a radially inner end 202 that is connected to the outer hub perimeter 172, and a radially outer end 204 that is connected to the hub interface wall 156. The strengthening ribs 200 can further define circumferentially outer boundaries, and can thus define an enclosed perimeter. The strengthening ribs 200 can transfer forces imparted onto the base due to negative internal pressure radially outward towards the deflection ribs 280.

Figure 14:
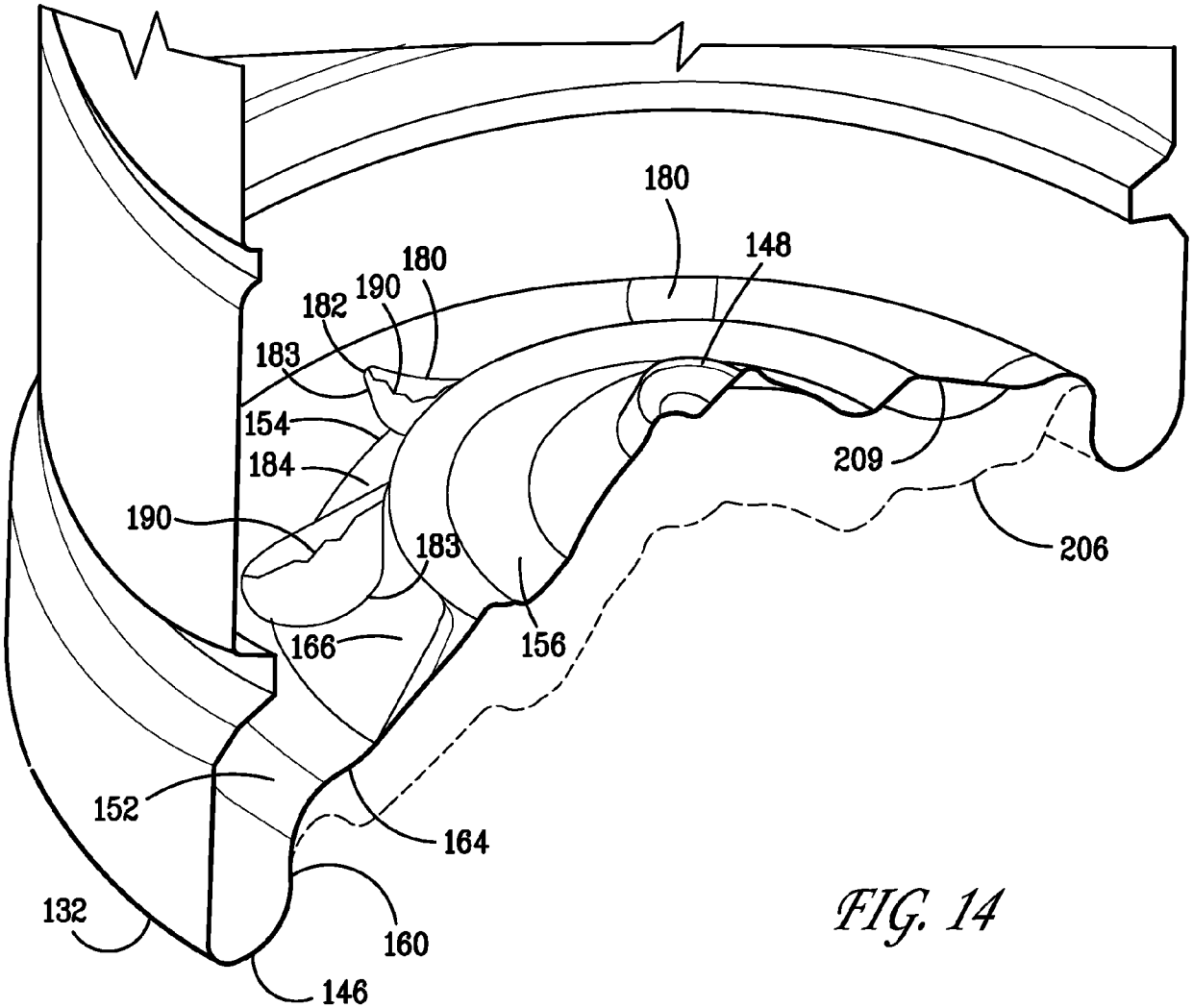
FIG. 14 is a sectional perspective view of the base illustrated in FIG. 9, showing the base in a deflected state.

Accordingly, referring now also to FIGS. 13-14, each rib 180 can create a deflection location 190 on the base 132, preferably within the structure of the rib 80 itself, that is configured to buckle upon the base displacing a predetermined amount in response to negative internal pressure accumulation.

As illustrated, each deflection location 190 can be disposed at the interface between the radially outer end 182 of the corresponding rib 180 and the sloped radial wall 164. The deflection location 190 can include portions of the radially outer end 182 of the rib 180 and the raised ring 152, or can alternatively include portions of the raised ring 152 and not the radially outer end 182, or alternatively still can include portions of the radially outer end 182 and not the raised ring 152. Portions of the raised ring 152 that can buckle include the upstanding wall 160, the curved upper wall 162, and the sloped radial wall 164. The deflection location 190 can alternatively or additionally include any and all portions of the rib 180.

FIG. 13 illustrates a phantomed profile of the base 132 in its as-molded state, or undeformed state 206. FIG. 13 further illustrates a profile 208 of the base 132 that has deformed to a deformed state, which causes the ribs 180 to bend in response to negative internal pressure. Stress concentrations disposed at the deflection locations 190 increase as the base 132 increasingly deforms due to increasing negative internal pressure.

As shown in FIG. 14, once the negative internal pressure increases to a threshold level, base body deformation causes the stress concentrations to increase to a level, which without being bound by theory is believed to be the yield point of the base material (such as PET), which in turn causes the deflection locations 190 to deflect, or buckle, thereby allowing the base 132 to become further deformed to a deflected state 209.

Figure 15:
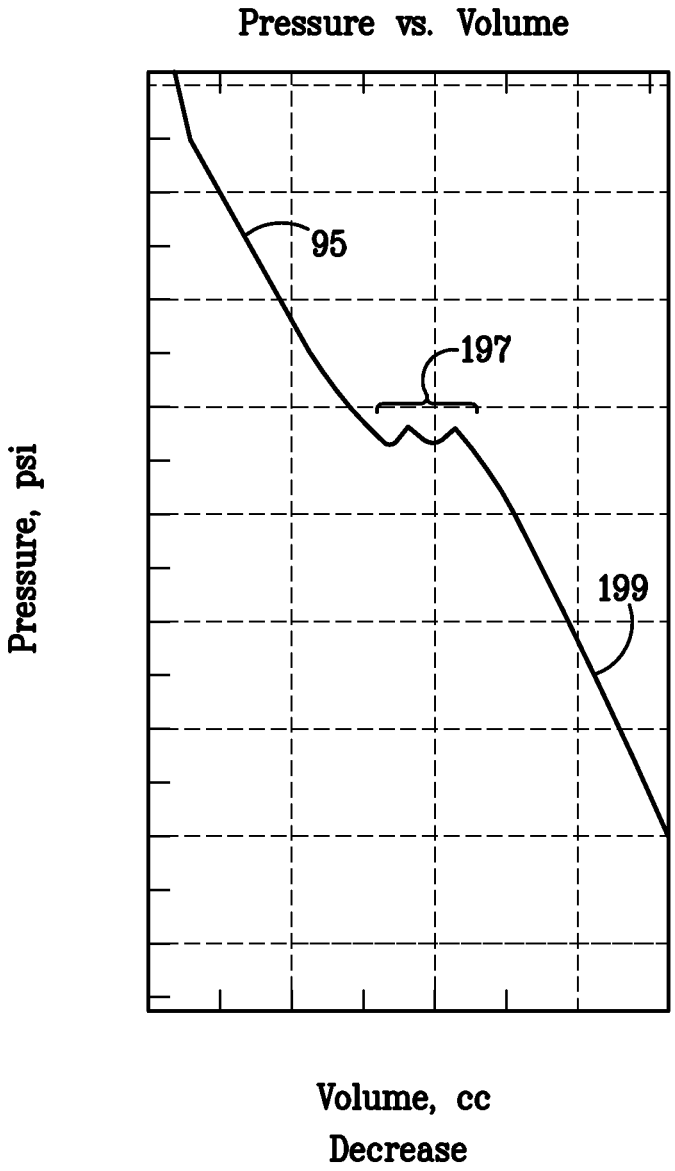
FIG. 15 is a graph plotting decrease in internal volume as a function of. increasing negative internal pressure of a container having a base as illustrated in FIGS. 9-14.

Referring also to FIG. 15, the decrease in container volume (CC) on the x-axis is plotted as a function of the increasing negative internal pressure on the y-axis. Each tick along the x-axis corresponds to 2.5 CC, such that the internal container volume decreases in a positive direction from the origin along the x-axis. Each tick along the y-axis corresponds to 0.25 psi, such that the magnitude of negative internal pressure decreases in a positive direction from the origin along the y-axis.

As the deflection location 190 buckles, the base 132 deforms in response to increasing negative internal pressure at a rate greater than the rate of base deformation in response to increasing negative internal pressure prior to buckling. Accordingly, as negative pressure begins to accumulate within the container, the base 132 begins to deform during a first deformation phase 195 which causes the container volume to decrease substantially linearly relative to the negative pressure increase. As the negative pressure continues to increase in magnitude, one or more of the deflection locations 190 buckle, at a second deformation, or deflection, phase 197, which causes the internal volume of the container to decrease as a function of increasing negative internal pressure at a rate greater than the rate of volume decrease as a function of negative internal pressure prior to buckling. As a result, the negative pressure dissipates in immediate response to buckling. If the negative pressure increase continues after buckling, the base 132 can deform during a third deformation phase 199 which causes the container volume to decrease substantially linearly relative to the negative pressure increase until the base 132 achieves its deflected state.

It should be appreciated that the first and third deformations phase 95 and 99 include gradual base deformation. The second deformation phase, or deflection phase 97, is reflected in a sharp change in slope of the pressure vs. volume curve, even approaching a discontinuity of the curve.

It should be appreciated that the actual negative internal pressures and container volume decreases associated with the first, second, and third deformation phases can vary based on various factors, for instance the base geometry, including material thickness, size of the base and its components, placement of the various components of the base, and the like. In the illustrated embodiment, the rib 180 is configured to buckle prior to any deflection or substantial deformation of the cylindrical body 134 of the container 130.

It should be further appreciated that the base 132 has been described as an alternative embodiment to base 32, and that the present invention is not intended to be limited to the particular geometry descried with reference to the base 132 or the other alternative embodiments described herein. One such additional alternative embodiment of the base 32 will now be described with reference to FIGS. 16-22.

Figure 16:
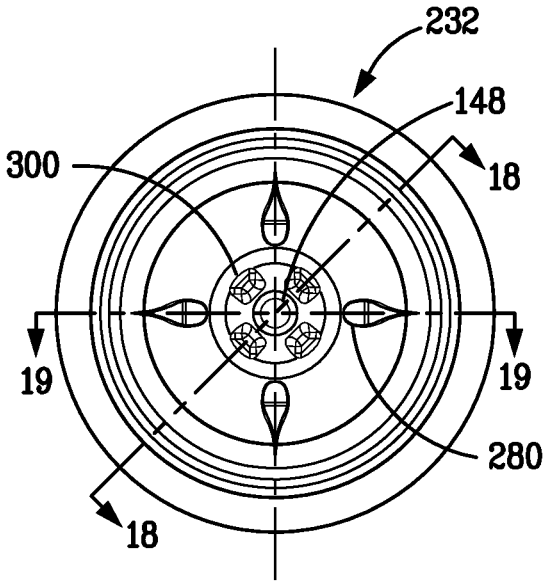
FIG. 16 is a bottom plan of a container of the type illustrated in FIG. 1, with the base constructed in accordance with another alternative embodiment and including a plurality of circumferentially spaced deflection ribs.
Figure 17:
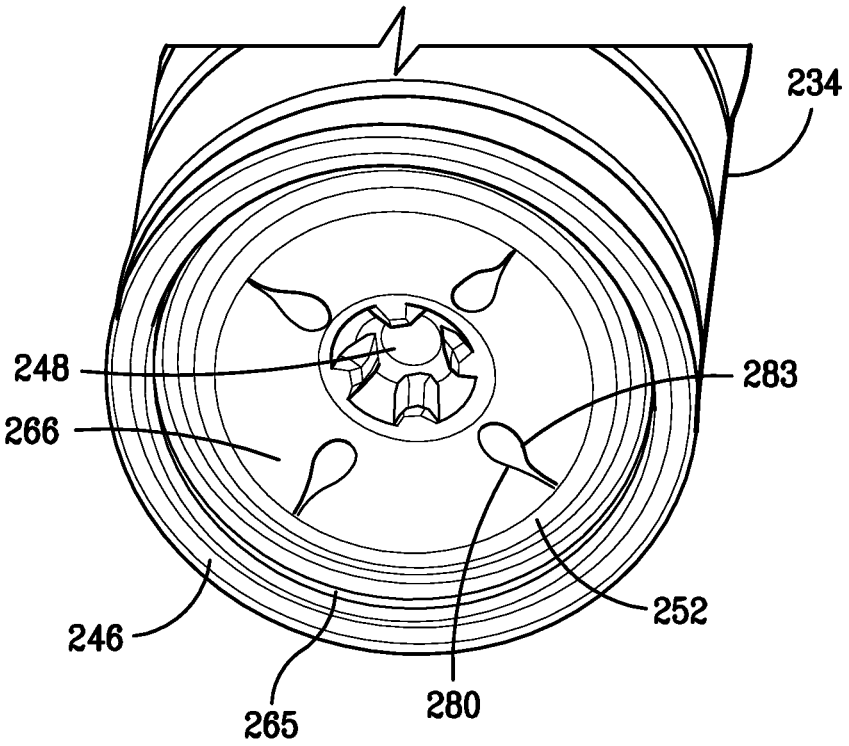
FIG. 17 is a perspective view of the base illustrated in FIG. 16 in its as-molded, or undeformed, state.
Figure 18:
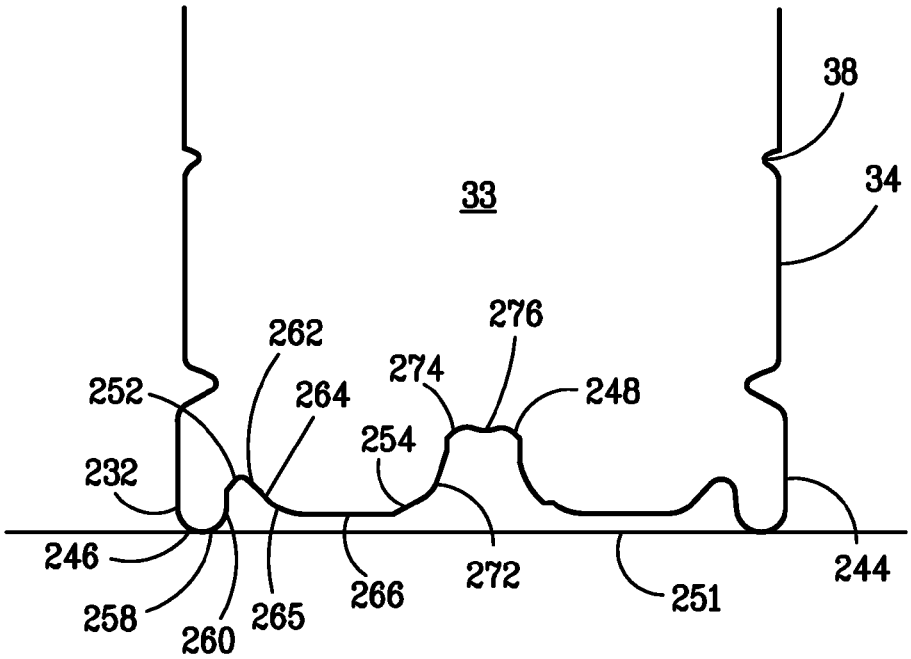
FIG. 18 is a sectional side elevation view of the base illustrated in FIG. 16, taken along line 18-18 through the deflection ribs, showing the container in its as-molded state, or undeformed, state.

Referring particularly to FIGS. 16-18, a base 232 constructed in accordance with an alternative embodiment is illustrated, whereby reference numerals of elements of the base 232 that correspond to like elements of the base 132 have been incremented by 100 for the purposes of clarity and illustration. It should be understood that the elements having reference numerals increased by 100 need not identify structure that is identical to the corresponding structure of the base 132.

The base 232 can include an annular heel 244 a standing ring 246 extending down from the heel 244, and a raised and generally concave reentrant portion or hub 248 that is substantially centrally disposed on the base 232. The standing ring 246 is configured to rest on a support surface 251.

The general structure of the base 232 can include the standing ring 246, an annular raised ring 252 disposed radially inward with respect to the standing ring 246, and an annular medial ring 254 disposed radially inward with respect to the raised ring 252.

Specifically, the standing ring 246 includes a curved convex bottom wall 258 connected at its radially outer end to the heel 244, and connected at its radially inner end to an upstanding wall 260 that can extend substantially vertically up (and can also extend slightly radially inwardly) from the convex bottom wall 258. The upstanding wall 260 can define the radially inner end of the standing ring 246. The upstanding wall 260 can also define the radially outer end of the raised ring 252, which is disposed radially inward with respect to the standing ring 246. The raised ring 252 can include a curved and concave upper wall 262 and a sloped radial wall 264 connected to the radially inner end of the upper wall 262. The radial wall 264 can extend vertically down and radially inward from the curved upper wall 262.

The sloped radial wall 264 can extend down to a curved convex ring interface portion 265 that defines a lowest point vertically offset from (above) the lowest point of the bottom wall 258 of the standing ring 246. The ring interface portion 265 extends radially inwardly to a substantially horizontal outer medial wall 266. It should be appreciated that the outer medial wall 266 could alternatively assume a convex or concave shape with respect to the support surface 251. The medial wall 266 is joined at its radially inner end to the medial ring 254, which is concave and defines an uppermost point that is disposed vertically lower than the highest point of the raised ring 252.

The radially inner end of the medial ring 254 is connected to a convex outer hub perimeter wall 272. The radially inner end of the outer hub perimeter 272 is connected to the radially outer end of an inner hub perimeter 274. The inner hub perimeter 274 is concave and defines an upper portion 275 that is disposed at a vertical position spaced above the radially inner end of the outer hub perimeter 272. The radially inner end of the inner hub perimeter 274 is attached to a convex depression 276 that is extends below the inner hub perimeter 274.

Figure 19:
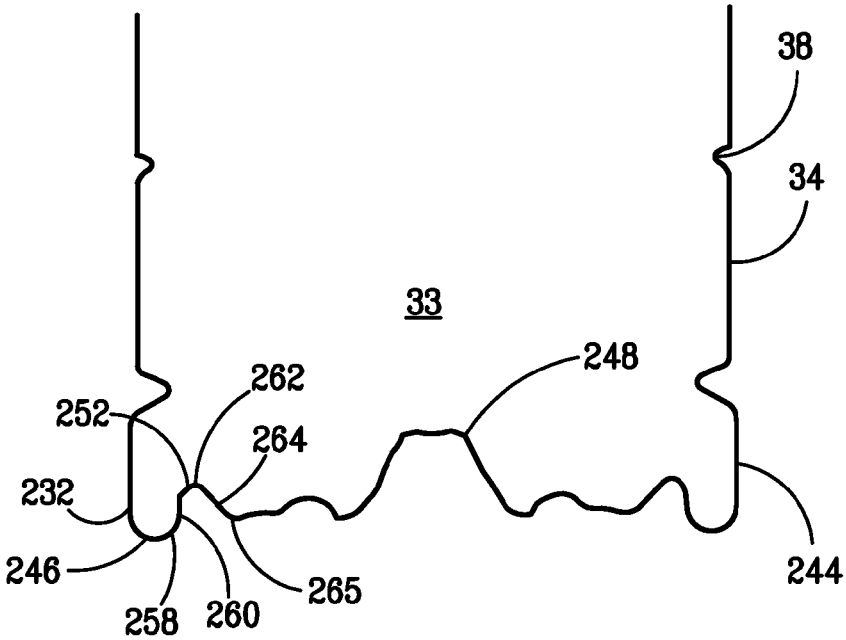
FIG. 19 is a sectional side elevation view of the base illustrated in FIG. 16 taken along line 19-19 outside the deflection ribs, showing the container in its as-molded state, or undeformed, state.

Referring now also to FIG. 19, the base 232 further includes deflection ribs 280 that can be spaced circumferentially about the base. Each rib 280 is not circumferentially continuous about the base, and thus defines an enclosed outer perimeter 283 having opposing outer circumferential boundaries (FIG. 9). The ribs 280 can be equally spaced circumferentially about the base 232. In the illustrated embodiment, four ribs 280 are shown spaced approximately 90° circumferentially from each other.

Figure 20:
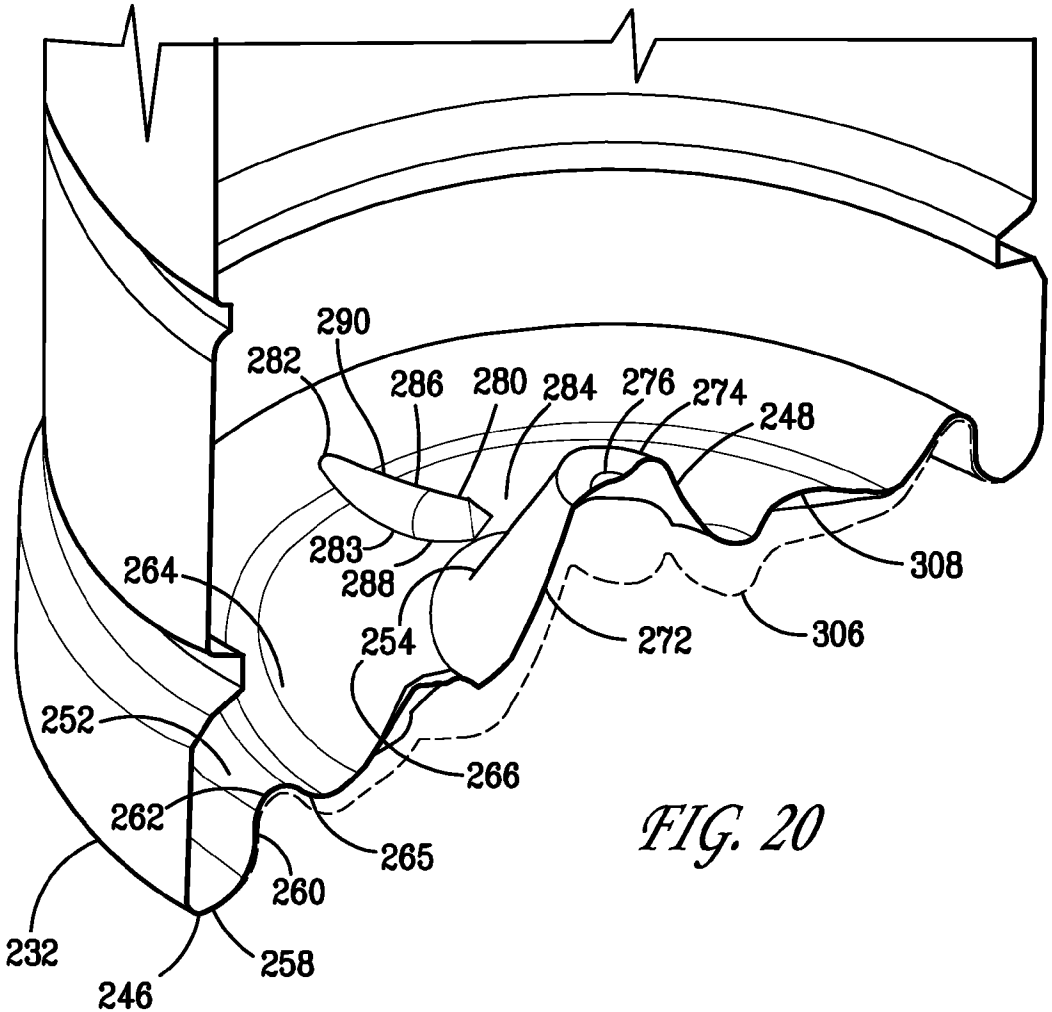
FIG. 20 is a sectional perspective view of a section of base illustrated in FIG. 16, showing the base in a deformed but undeflected state.

Referring also to FIG. 20, each rib 280 can be radially elongate, and can extend between the standing ring 246 and the hub 248. More particularly, each rib can extend between the raised ring 252 and the medial ring 254. Broadly stated, each rib 280 can be connected between two or more (e.g., at least a pair of) differently sloped surfaces of the base. In the illustrated embodiment, each rib 280 can terminate at a radially outer end 282 that is connected to the raised ring 252, and can further terminate at its radially inner end 284 which is connected to the medial ring 254. Each rib 280 can thus be said to extend between, and be connected between, the raised ring 252 and the medial ring 254. Specifically, the radially outer end 282 of each rib 280 can be connected to the sloped radial wall 264, and the radially inner end 284 of each rib 280 can be connected to the radially inner end of the medial ring 254 at a location proximate to the outer medial wall 266.

Each rib 280 can extend up from the surrounding base structure, and can be circumferentially convex and thus define a circumferential middle portion 286 that is spaced above a pair of circumferential end portions 288 that are attached to the surrounding base 232. The middle portion 286 and end portions 288 can be round in cross section. Furthermore, the radially outer end 282 can define a circumferential width that is less than the circumferential thickness of the radially inner end 284 such that the rib 280 defines the shape of a teardrop.

The base 232 further includes one or more convex strengthening ribs 300 circumferentially offset with respect to the deflection ribs 280. Each strengthening rib 300 can extend between the hub 248 and a location inward with respect to the deflection ribs 280. In particular, each strengthening rib 300 can define a radially inner end 302 that is connected to the inner hub perimeter 274, and a radially outer end 304 that is connected to the outer hub perimeter 272. The strengthening ribs 300 can further define circumferentially outer boundaries, and can thus define an enclosed perimeter. The strengthening ribs 300 can transfer forces imparted onto the base due to negative internal pressure radially outward towards the deflection ribs 280.

Figure 21:
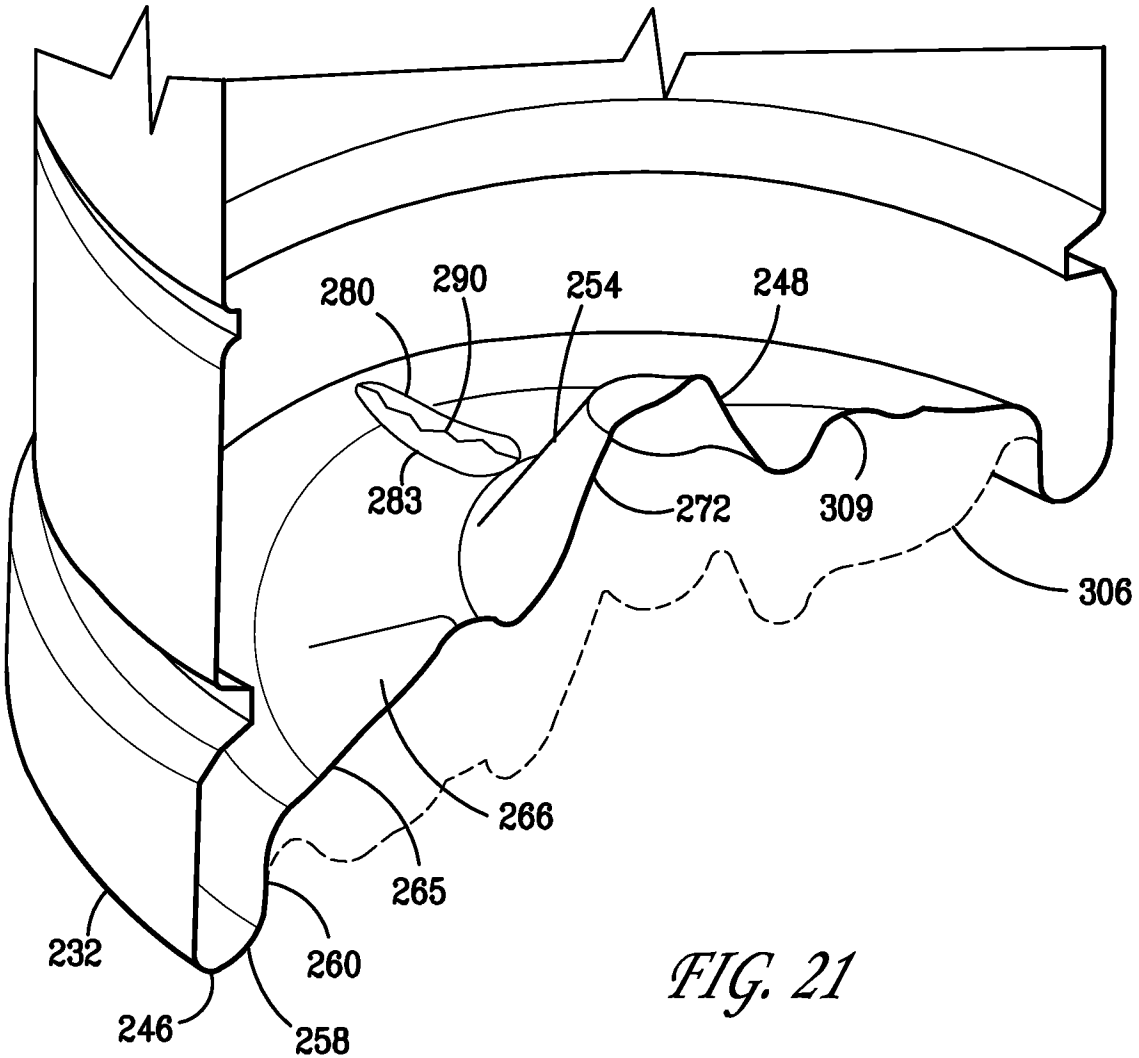
FIG. 21 is a sectional perspective view of the base illustrated in FIG. 16, showing the base in a deflected state.

Accordingly, referring now also to FIGS. 20-21, each rib 280 can create a deflection location 290 on the base 232, preferably within the structure of the rib 80 itself, that is configured to buckle upon the base displacing a predetermined amount in response to negative internal pressure accumulation.

As illustrated, each deflection location 290 can be disposed at the interface between the radially outer end 282 of the corresponding rib 280 and the sloped radial wall 264. The rib 280 can transfer forces, such that the deflection location 290 can include portions of the radially outer end 282 of the rib 280 and the raised ring 252, or can alternatively include portions of the raised ring 252 and not the radially outer end 282, or alternatively still can include portions of the radially outer end 282 and not the raised ring 252. Portions of the raised ring 252 that can buckle include the upstanding wall 260, the curved upper wall 262, and the sloped radial wall 264. The deflection location 290 can alternatively or additionally include any and all portions of the rib 280.

FIG. 20 illustrates a phantomed profile of the base 232 in its as-molded state, or undeformed state 306. FIG. 20 further illustrates a profile 308 of the base 232 that has deformed to a deformed state in response to an increase in negative internal pressure, which causes the ribs 280 to bend. Stress concentrations disposed at the deflection locations 290 increase as the base 232 increasingly deforms due to increasing negative internal pressure.

As shown in FIG. 21, once the negative internal pressure increases to a threshold level, base body deformation causes the stress concentrations to increase to a level, which without being bound by theory is believed to be the yield point of the base material (such as PET), which in turn causes the deflection location 290 to deflect or buckle, thereby allowing the base 232 to further deform to a deflected state 309.

Figure 22:
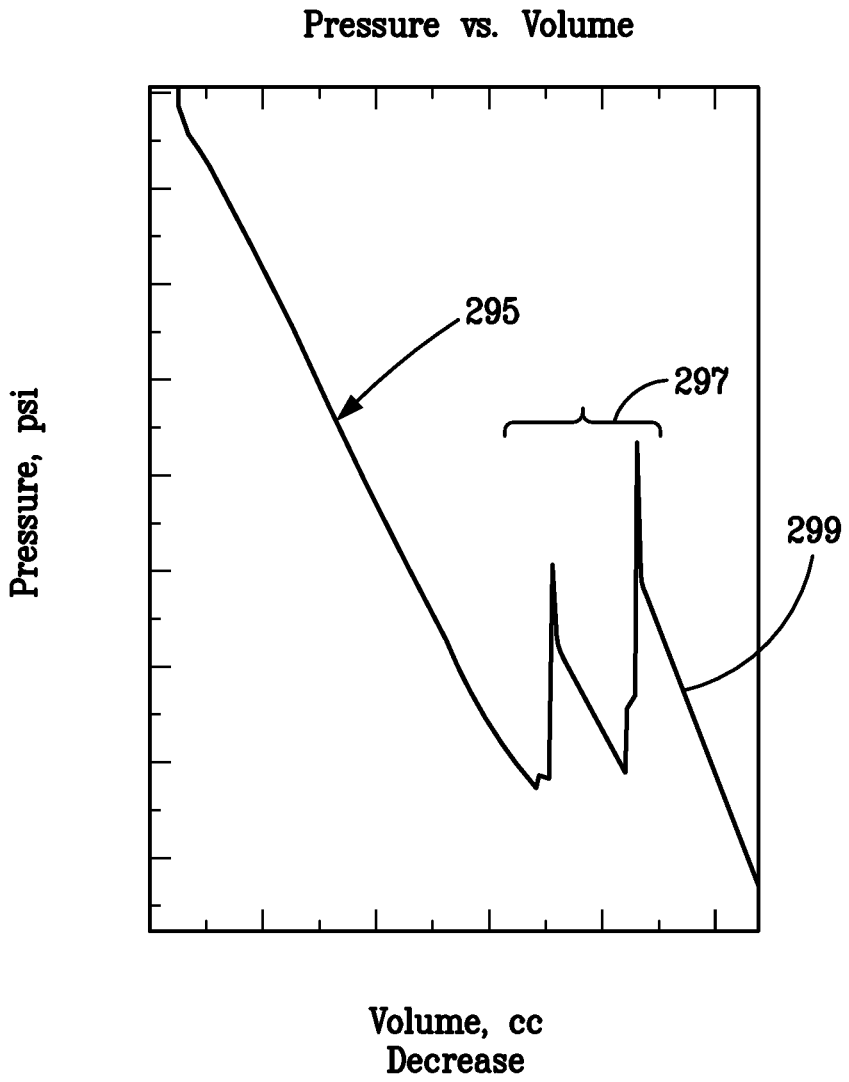
FIG. 22 is a graph plotting decrease in internal volume as a function of. increasing negative internal pressure of a container having a base as illustrated in FIGS. 16-21.
Figure 23:
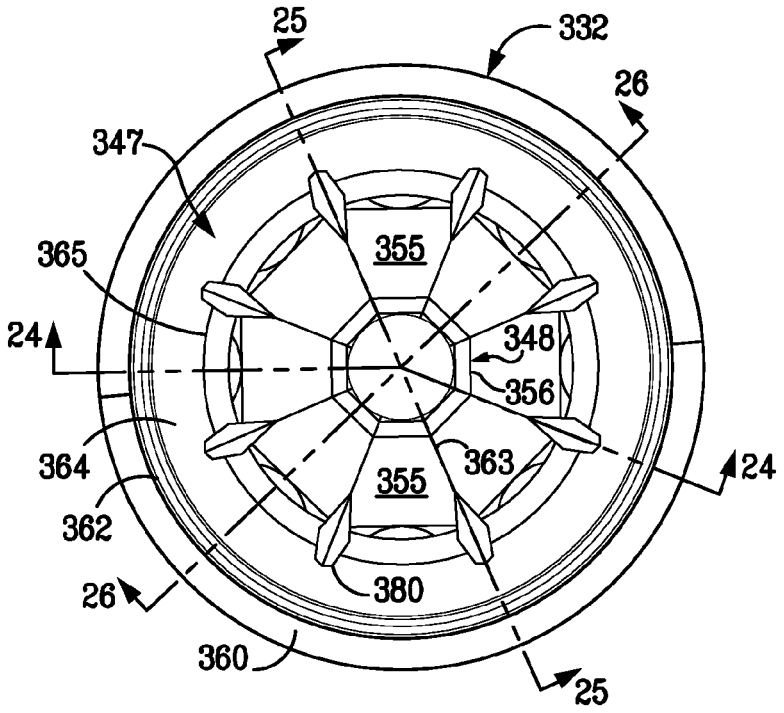
FIG. 23 is a schematic bottom view of a container of the type illustrated in FIG. 1 showing a base constructed in accordance with another alternative embodiment having including a plurality of circumferentially spaced deflection ribs and ribs at the interstices between adjacent deflection ribs.
Figure 24:
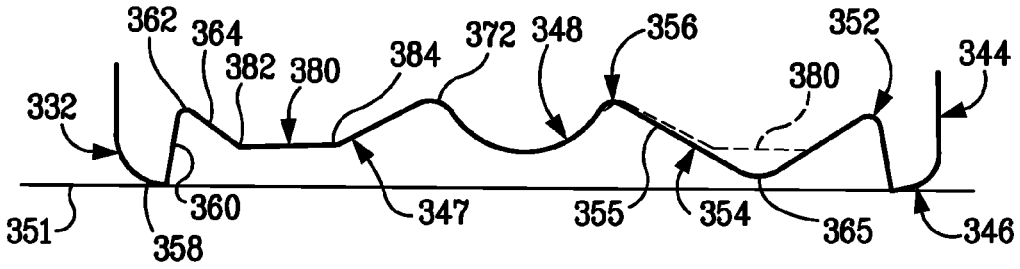
FIG. 24 is a sectional side elevation view of the base illustrated in FIG. 23 taken along line 24-24, rotated 180° with respect to FIG. 23, showing the base in an as-molded, or undeformed, state.

Referring also to FIG. 22, the decrease in container volume (CC) on the x-axis is plotted as a function of the increasing negative internal pressure on the y-axis. Each tick along the x-axis corresponds to 2.5 CC, such that the internal container volume decreases in a positive direction from the origin along the x-axis. Each tick along the y-axis corresponds to 0.25 psi, such that the magnitude of negative internal pressure decreases in a positive direction from the origin along the y-axis.

As the deflection location 290 buckles, the base 232 deforms in response to increasing negative internal pressure at a rate greater than the rate of base deformation in response to increasing negative internal pressure prior to buckling. Accordingly, as negative pressure begins to accumulate within the container, the base 232 begins to deform during a first deformation phase 295 which causes the container volume to decrease substantially linearly relative to the negative pressure increase. As the negative pressure continues to increase in magnitude, one or more of the deflection location 290 buckles, at a second deformation, or deflection, phase 297, which causes the internal volume of the container to decrease as a function of increasing negative internal pressure at a rate greater than the rate of volume decrease as a function of negative internal pressure prior to buckling. As a result, the negative pressure dissipates in immediate response to buckling. If the negative pressure increase continues after buckling, the base 232 can deform during a third deformation phase 299 which causes the container volume to decrease substantially linearly relative to the negative pressure increase until the base 232 achieves its deflected state.

It should be appreciated that the first and third deformations phase 95 and 99 include gradual base deformation. The second deformation phase, or deflection phase 97, is reflected in a sharp change in slope of the pressure vs. volume curve, even approaching a discontinuity of the curve.

It should be appreciated that the actual negative internal pressures and container volume decreases associated with the first, second, and third deformation phases can vary based on various factors, for instance the base geometry, including material thickness, size of the base and its components, placement of the various components of the base, and the like. In the illustrated embodiment, the rib 280 is configured to buckle prior to any deflection or substantial deformation of the cylindrical body 234 of the container 230.

It should be further appreciated that the bases illustrated and described above described are provided by way of example, and that another alternative embodiment will now be described with reference to FIGS. 23-30.

Referring particularly to FIGS. 23-27, a base 332 constructed in accordance with an alternative embodiment of the invention is illustrated, whereby reference numerals of elements of the base 332 that correspond to like elements of the base 232 have been incremented by 100 for the purposes of clarity and illustration. It should be understood that the elements having reference numerals increased by 100 need not identify structure that is identical to the corresponding structure of the base 232.

The base 332 can include an annular heel 344, and a chime or standing ring 346 extending down from the heel 344 that is configured to rest on a support surface 351. As shown in FIGS. 32A-E, the chime or standing ring 346 can be constructed in accordance with one of many alternative embodiments illustrated as geometric structures other than rings. It should be appreciated that FIG. 32 illustrates some alternative embodiments, and that any suitable alternative standing ring suitable for supporting a container on a support surface can be provided. When the support surface 351 extends horizontally, the bottle extends substantially vertically. The base 332 further includes a recessed (or pushed-down) reentrant portion or hub 348 that is substantially centrally disposed on the base 332 and convex with respect to a support surface 351 of the base. A base body 347 adjoins the standing ring 346 to the hub 348. Because the hub 348 is recessed, the base 332 more closely resembles the geometry of the preform base, and the base 232 is therefore more inclined to maintain its shape as the container temperature approaches its glass transition temperature, for instance during the hot fill process.

The base body 347 can include an annular raised ring 352 disposed radially inward with respect to the standing ring 346, an annular medial member 354, which can be arranged as a plurality of adjoining medial panels 355 disposed radially inward with respect to the raised ring 352. A hub interface wall 356 joins the medial member 354 to the hub 348. It can be said that the medial panels 355 provide a paneled base body 347.

The standing ring 346 includes a curved convex bottom wall 358 connected at its radially outer end to the heel 344, and connected at its radially inner end to an upstanding wall 360 that can extend substantially vertically above (and can also extend slightly radially inwardly from) the convex bottom wall 358. The upstanding wall 360 can define the radially inner end of the standing ring 346. The upstanding wall 360 can also define the radially outer end of the raised ring 352, which is disposed radially inward with respect to the standing ring 346. The raised ring 352 can include a curved and concave upper wall 362 and a sloped radial wall 364 connected to the radially inner end of the upper wall 362. The radial wall 364 can extend vertically down and radially inward from the curved upper wall 362.

The sloped radial wall 364 can extend down to a curved convex ring interface portion 365 that defines a lowest point vertically offset from (above) the lowest point of the bottom wall 358 of the standing ring 346. The ring interface portion 365 extends radially inwardly and up to the medial member 354, which is concave and radially elongate.

Each medial panel 355 defines a radially inner end 359 that extends substantially straight and tangential to the hub 348. Each medial panel 355 further defines a radially outer end 361 that extends parallel to the radially inner end 359. The radially outer end 361 has a length that is greater than that of the radially inner end 359. Because the radially inner end is disposed at a vertical position spaced above the radially outer end 361 when the container is in its as-molded state, it can be said that each medial panel 355 slopes upward along a radially inward direction from the standing ring 346 toward the hub 348. Each medial panel 355 further defines substantially straight opposing circumferentially outer ends 363 that are connected between the radially inner and outer ends 369 and 361, respectively. The outer ends 363 define interstices between adjacent medial panels 355 of the medial member 354. The interstices 363 can extend between and from the radially outer end of the medial panel 355 to the hub interface wall 356, or to a location disposed radially outward with respect to the hub interface wall 356. Alternatively still, the interstices 363 can extend into the hub interface wall 356. The interstices 363 can be positioned collinearly with respect to a radial axis extending out from the center of the hub 348. The interstices 363 can define a vertex between adjacent medial panels 355.

Each medial panel 355 is thus defined by ends 359, 361, and 363, and can be substantially flat with respect to the circumferential and radial directions, though it should be appreciated that the medial wall could be curved concave, convex, or include concave and convex portions, in either or both of the circumferential and radial directions. In the illustrated embodiment, the plural medial panels can define surfaces that are not axially coplanar with each other in a circumferential direction about the base.

The base 332 is illustrated as including eight such medial panels 355 that are substantially identically constructed and equally spaced circumferentially about the base 332. The medial member 354 can thus be said to resemble the shape of a steel pan drum. It should, however, be appreciated that the base 332 can include any number of such panels 355 as desired, which can be evenly or unevenly spaced about the circumference of the base 332. Furthermore, as shown in FIG. 31, medial panels 355 can assume different shapes, such as those illustrated at 355A-C. Some medial panels can define curved radially inner end surfaces, some medial panels can define substantially flat radially inner end surfaces, and some container bases can include a combination of medial panels that have both flat and radially inner end surfaces. The medial panels 355A-C can extend between the hub 348 and the standing ring 346, or can extend as described above with respect to panels 355. Furthermore, while the panels 355A-C are illustrated as being positioned on a base having upstanding hubs 348A-C, it should be appreciated that the hub 348 can be recessed in the manner described above.

The annular medial member 354 defines an uppermost point that is connected to the hub interface wall 356, which is concave and extends above and radially in from the inner medial member 354. The hub interface wall 356 can further define a concave curvature. The upper and radially inner end of the hub interface wall 356 can connect to a hub perimeter 372 of the hub 348, which extends down from the perimeter 372. While the hub 348 is continuously curved and concave as illustrated, it should be appreciated that the hub 348 could define any alternative geometric structure. Because the hub 348 is recessed, it more closely resembles the shape of the perform from which the container is fabricated, and is therefore less likely to deform, for instance, when the container is heated above the transition temperature, with respect to a hub 348 that is pushed up with respect to the hub interface wall 358 in the absence of additional support structure.

With continuing reference to FIGS. 23-27, the base 332 further includes one or more deflection ribs 380, such that a plurality of deflection ribs can be spaced circumferentially about the base. Each rib 380 is not circumferentially continuous about the base, and thus defines an enclosed outer perimeter 383 having opposing outer circumferential boundaries. The ribs 380 can be equally spaced circumferentially about the base 332, and can further be in radial alignment with each other. In the illustrated embodiment, eight ribs 380 are shown spaced approximately 45° circumferentially from each other.

Each rib 380 can be radially elongate, and can extend between, and be connected between, the raised ring 352 and the annular medial member 354. Broadly stated, each rib 380 can be connected between two or more (e.g., at least a pair of) differently sloped surfaces of the base. In one embodiment, each rib 380 is connected at its radially inner end 384 to the annular medial member 354, and is further connected at its radially outer end 382 to the sloped radial wall 364 of the raised ring 352. Each rib 380 can be connected anywhere along the length of the annular medial member 354, and furthermore anywhere along the length of the sloped radial wall 364.

Figure 27:
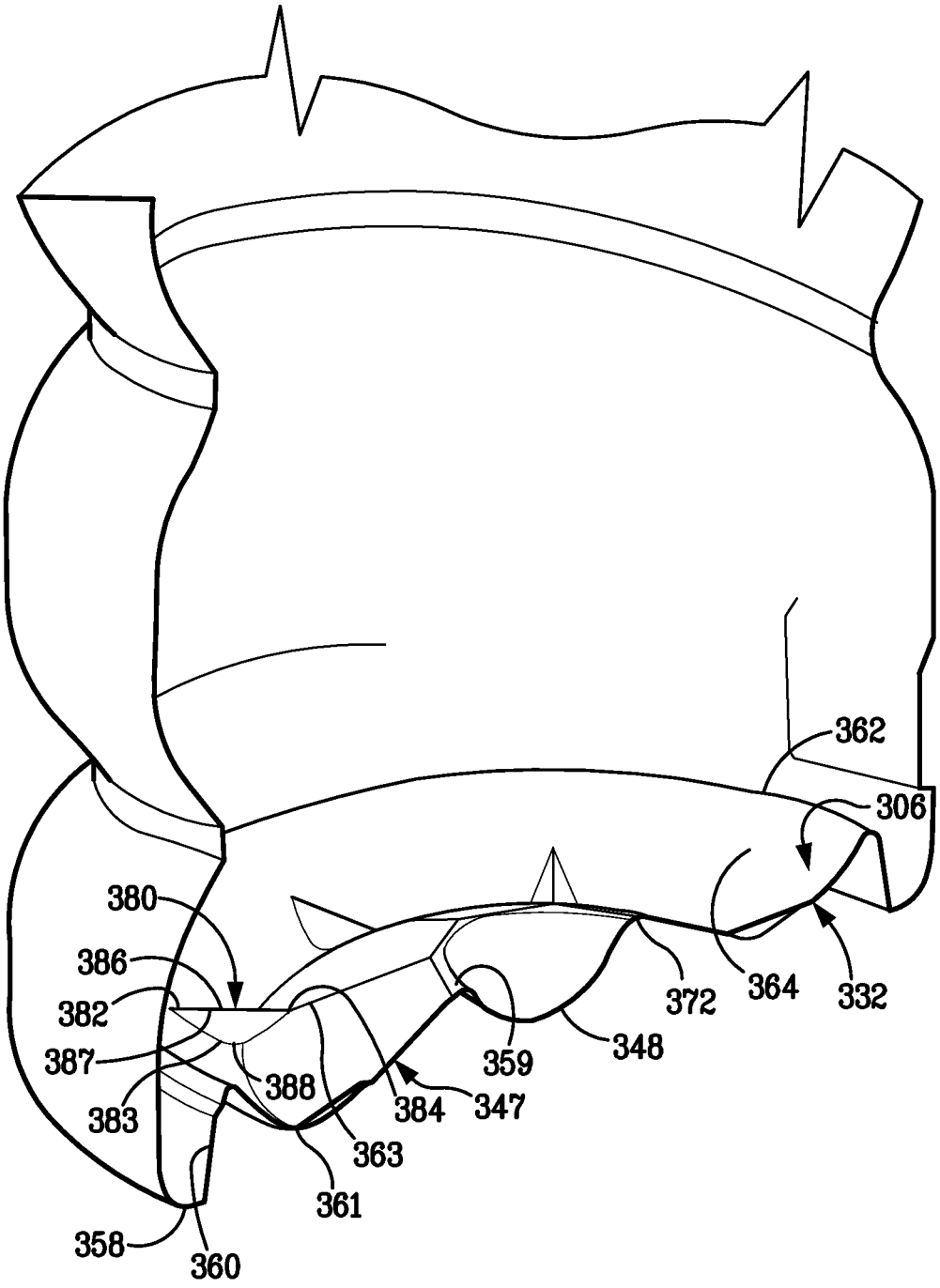
FIG. 27 is a sectional perspective view of a section of the base illustrated in FIG. 23, showing the base in the as-molded, or undeformed state.

As best shown in FIG. 27, each rib 380 can extend up from the surrounding base structure, and can define a circumferentially middle portion 386 spaced above a pair of circumferential end portions 388 that are attached to the surrounding base 332. Thus, each rib 380 can project up to a location that is out of plane with respect portions of the raised ring 352 and the annular medial member 354 that circumferentially spaced and radially aligned with the rib. The middle portion 386 and end portions 388 can define a substantially triangular cross section (that is, taken transverse to a radial line defined by the base). The middle portion 386 defines an upper surface 387 that is substantially flat and can be inclined such that the radially inner end 384 is disposed at a vertical position spaced above the radially outer end 382. The upper surface 387 is radially aligned with the interstice 363 between adjacent panels 355. Furthermore, the radially outer end 382 can define a circumferential width that is substantially equal to the circumferential thickness of the radially inner end 384. In this regard, each rib 380 can be radially symmetrical about its radial midpoint, and can further be circumferentially symmetrical about its circumferential midpoint.

It should be appreciated that the base 332 can include can include any number of ribs 380 spaced at any location circumferentially evenly or unevenly about the base. For instance, the ribs 380 can be disposed between interstices 363, for instance at a location circumferentially midway between adjacent interstices 363. Alternatively, certain ribs 380 can be aligned with the interstices 363 while other ribs 380 are disposed between adjacent interstices 363. Furthermore, while each interstice 363 is associated with a radially aligned rib 380, it should be appreciated that a rib need not be provided for every interstice, and that a rib could alternatively be provided at every other interstice, or provided in any other desired pattern. In accordance with one embodiment, the ribs are symmetrically disposed circumferentially about the base 332.

Each rib 380 can create a deflection location 390 on the base 332, preferably within the structure of the rib 80 itself, that is configured to buckle upon the base displacing a predetermined amount in response to negative internal pressure accumulation. Accordingly, the rib 380 provides a geometry that causes a portion of the base 332 to initially resist deflection in response to an increase of negative internal pressure before buckling, or deflecting, which thereby decreases the resistance to increases in negative internal pressure increases. While the geometry of the rib 380 is a raised diamond shape in top-view as illustrated, it should be appreciated that the rib 380 could be a recessed structure, and could define any desired shape as an alternative to the illustrated diamond-shape. Furthermore, while cooling of the liquid causes an increase in negative internal pressure, it is also appreciated that in some situations, depending on the material of the container wall, moisture can egress through the container wall over time, thereby causing additional negative internal pressure to build. Deflection of the base 332 is configured to deflect in response to this additional negative internal pressure, thereby maintaining the integrity of the container side walls.

Each deflection location 390 can include portions or all of the associated rib 380, and can alternatively or additionally include portions of the associated medial panel 355 disposed adjacent the rib 380, the interstice 363, and alternatively or additionally portions of the associated sloped radial wall 364 disposed adjacent the rib 380.

Figure 28:
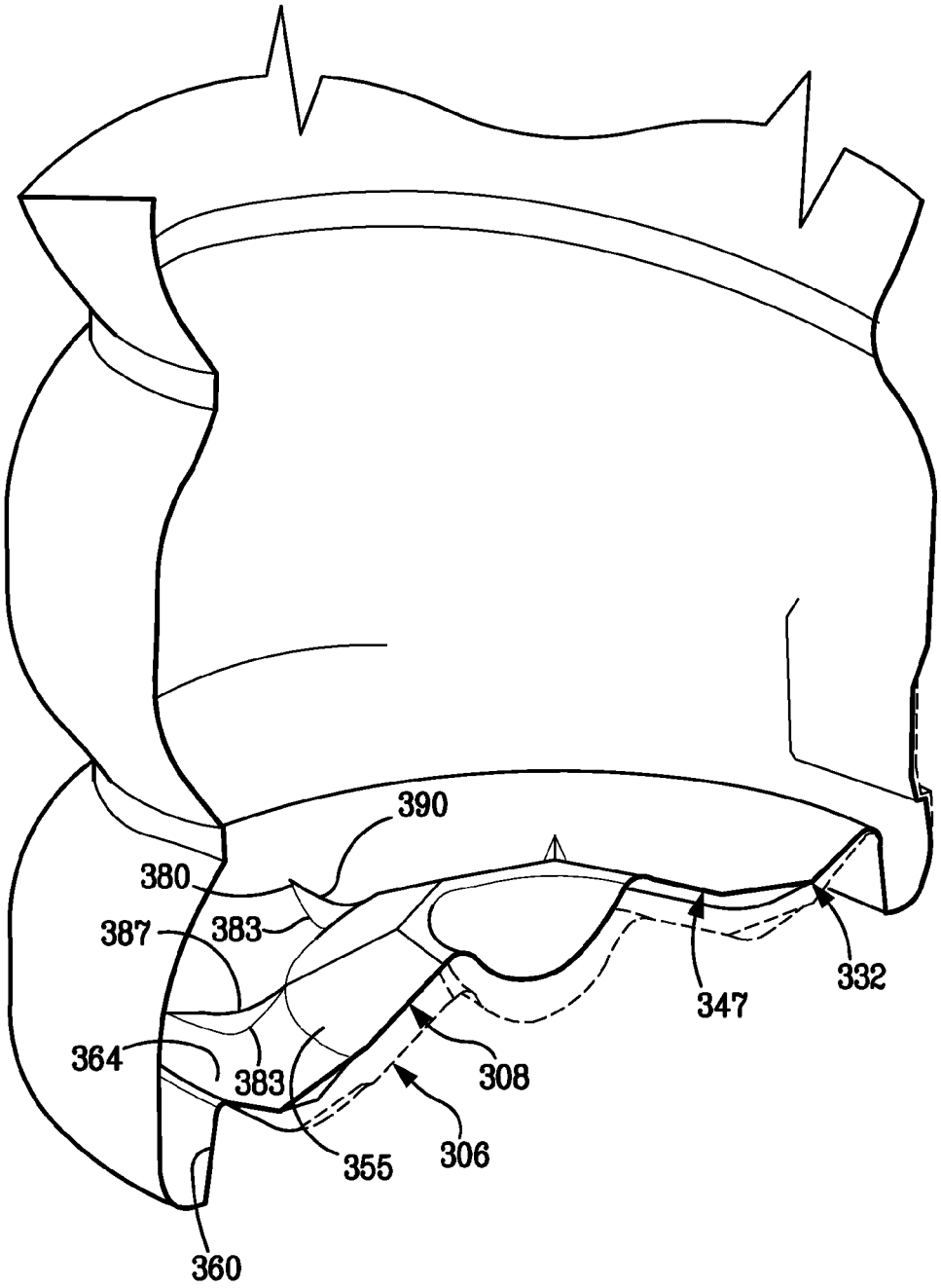
FIG. 28 is a sectional perspective view of a section of the base similar to that illustrated in FIG. 27, but showing the base in a deformed but undeflected state.

FIG. 27 illustrates a phantomed profile 306 of the base 332 in its as-molded state, or undeformed state. FIG. 28 illustrates a profile 308 of the base 332 after deforming to a deformed state, with respect to the undeformed profile 306, in response to a first level of negative internal pressure, which causes the ribs 380 to bend. Stress concentrations amass at the deflection locations 390 that increase as the base 332 increasingly deforms due to increasing negative internal pressure.

Figure 25:
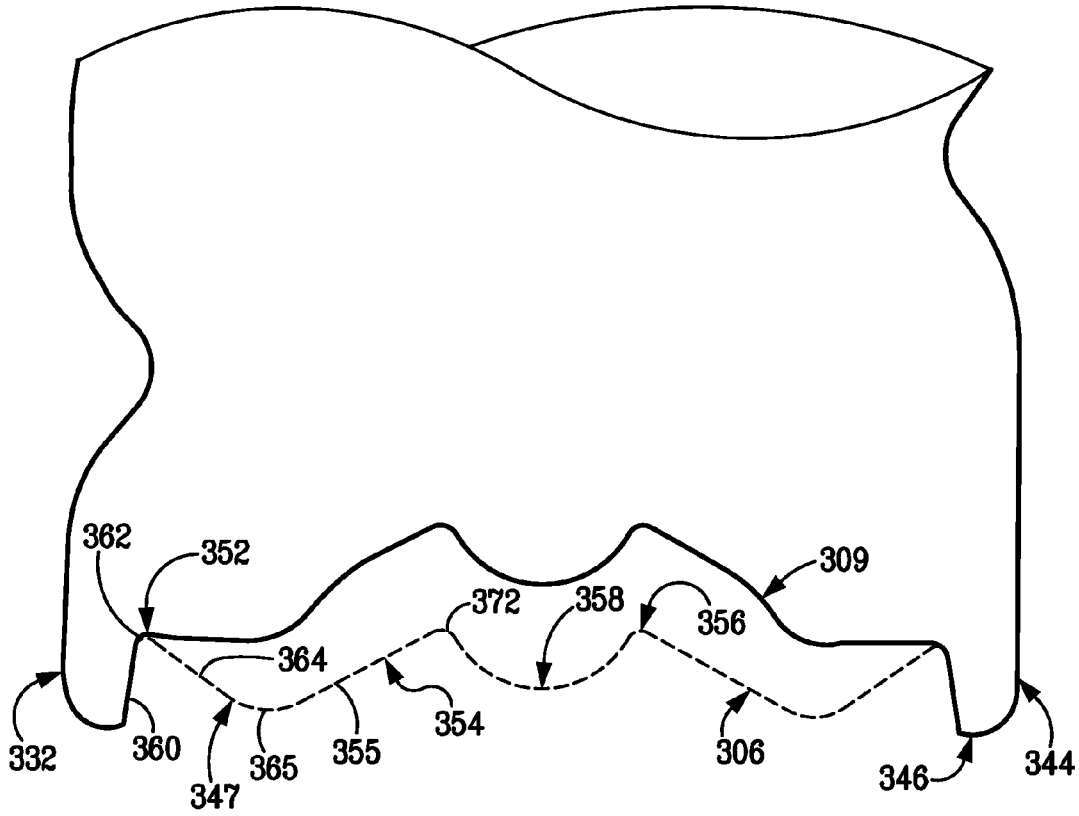
FIG. 25 is a sectional side elevation view of the base illustrated in FIG. 23 taken along line 25-25, and showing the base in both an as-molded, or undeformed state, and in a deflected state.
Figure 26:
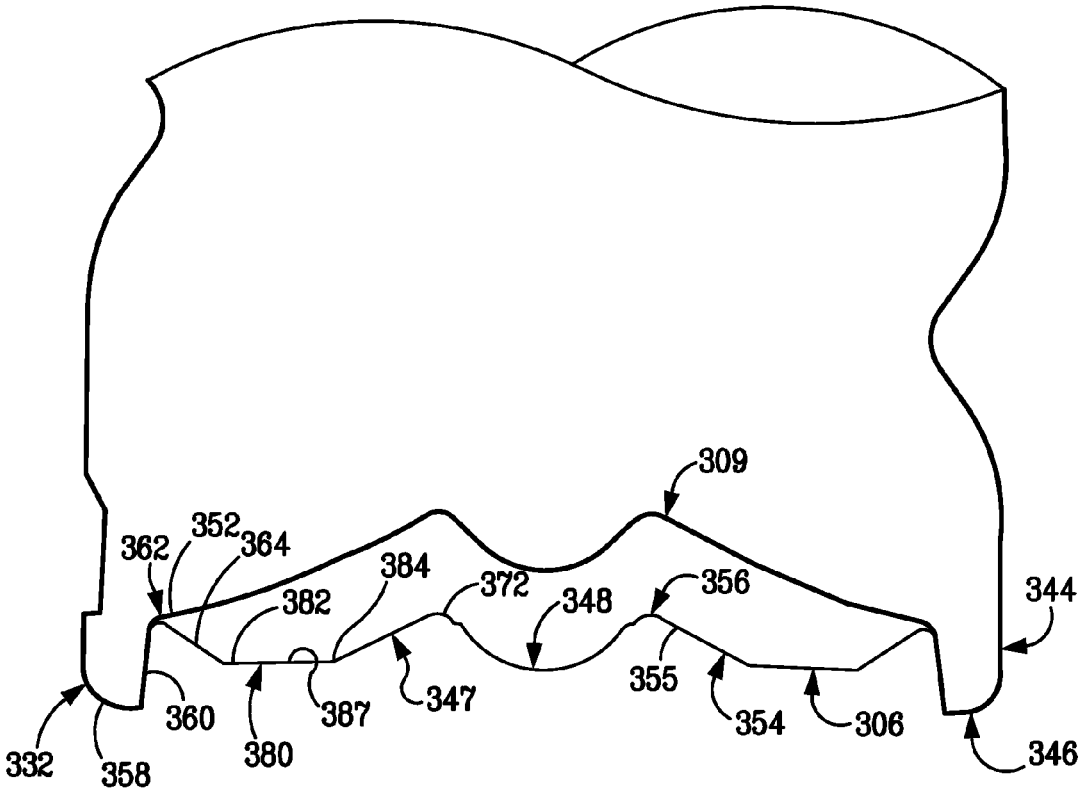
FIG. 26 is a sectional side elevation view of the base illustrated in FIG. 23 taken along line 26-26 in both an as-molded, or undeformed state, and also in a deflected state.
Figure 29:
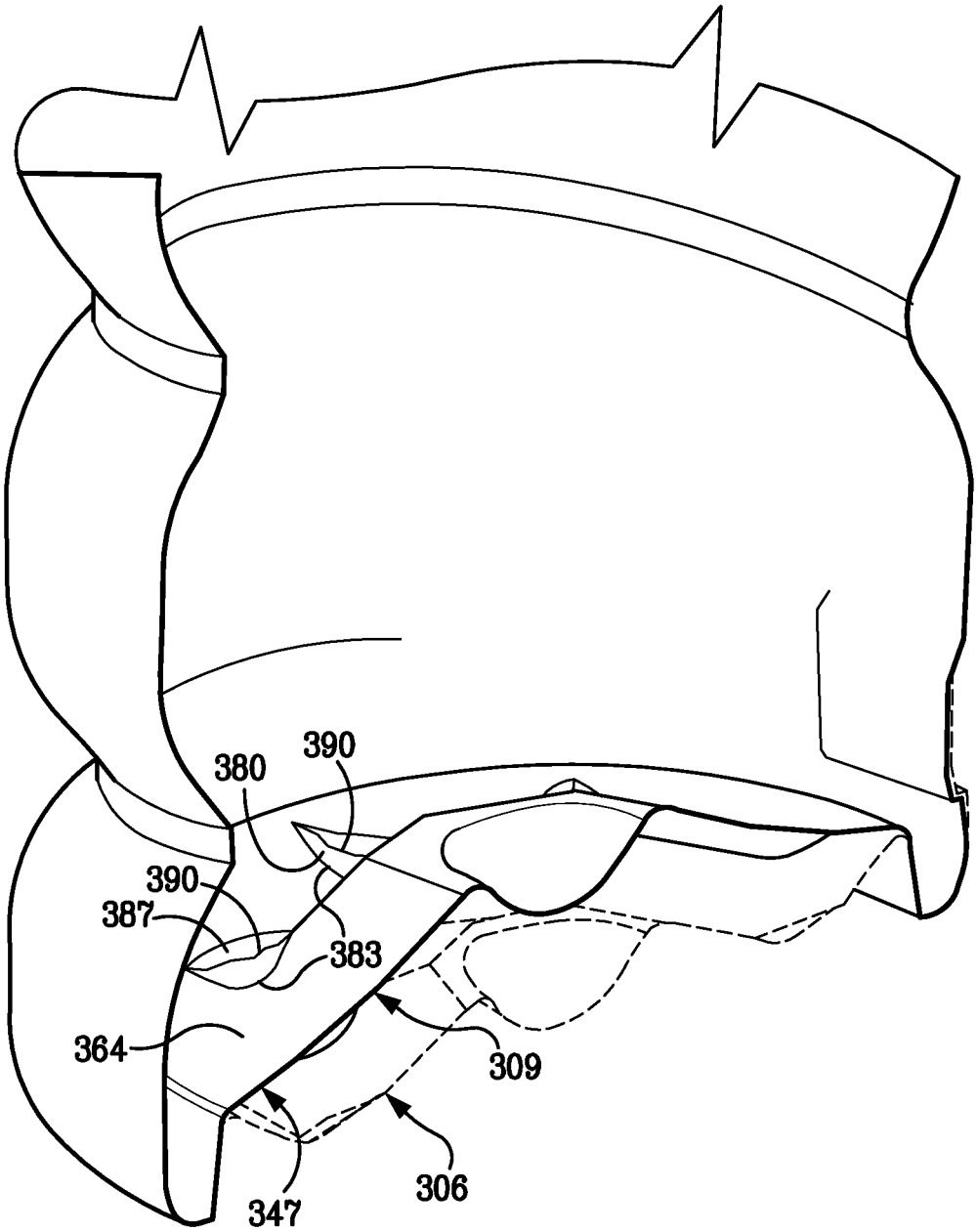
FIG. 29 is a sectional perspective view of the base similar to that illustrated in FIG. 28, but showing the base in a deflected state.

As shown in FIGS. 25, 26, and 29, once the magnitude of negative internal pressure increases to a second threshold level of negative internal pressure, the stress concentrations of one or more of the deflection locations 390 reach a level, which without being bound by theory is believed to be the yield point of the base material (such as PET), which in turn causes the deflection locations 390 of the corresponding deflection ribs 380 to deflect, or buckle, thereby causing the base 332 to deflect to a deflected state 309 that is greater than the deformed state.

FIG. 25 illustrates a cross-section of the base 332 through the circumferential midpoint of opposing ribs 380, and shows the base in both the undeformed state 306 and in the fully deflected state 309. As shown in FIG. 26, the base body 347 can pivot, or hinge, about the raised ring 352 or sloped radial wall 364 towards the fully deflected state. FIG. 26 illustrates a cross section of the base 332 at a location circumferentially midway between adjacent ribs 380, and shows the base in both the undeformed state 306 and in the fully deflected state 309.

Figure 30:
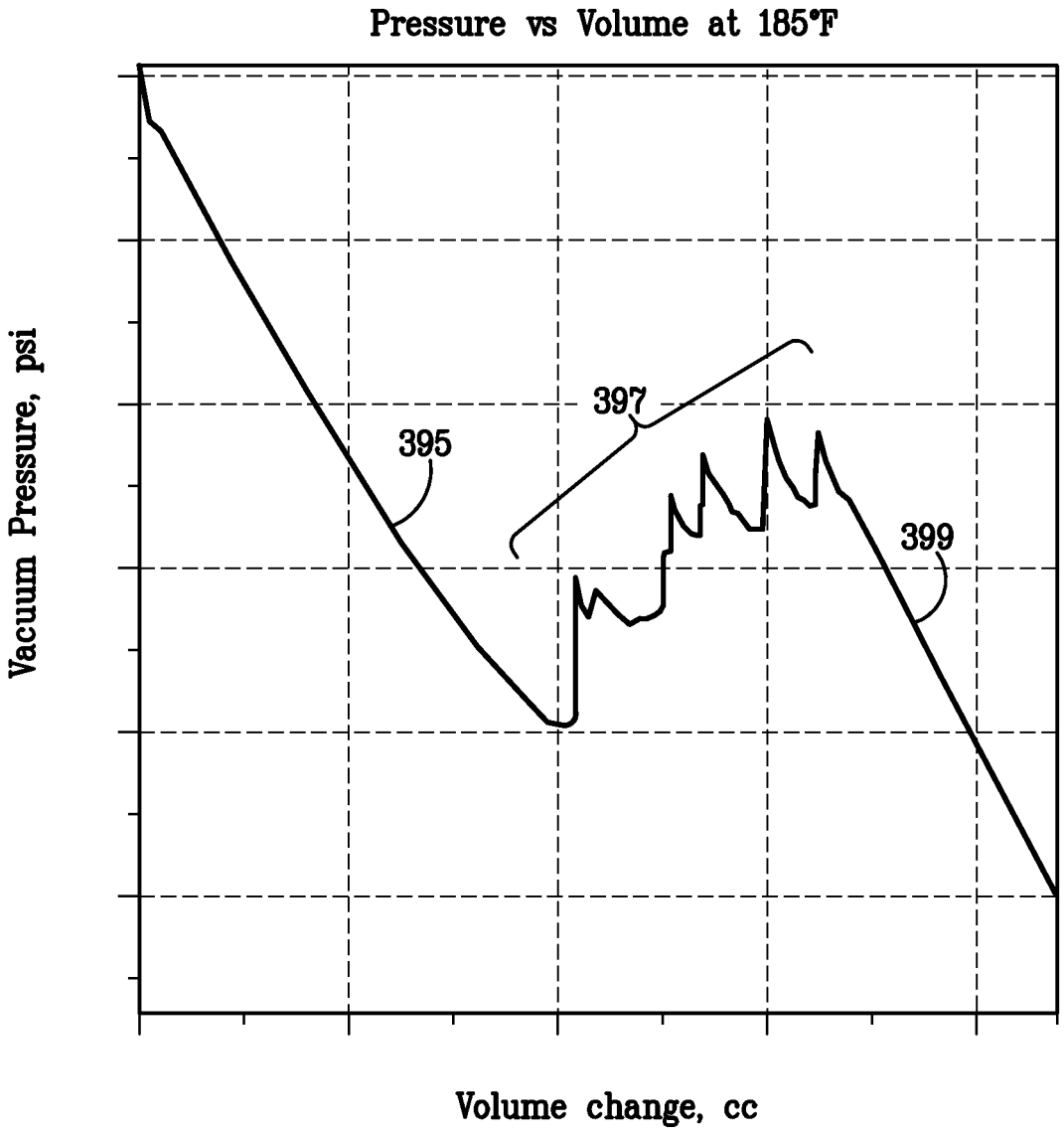
FIG. 30 is a graph plotting decrease in internal volume as a function of. increasing negative internal pressure of a container having a base as illustrated in FIGS. 23-28.
Figure 31A:
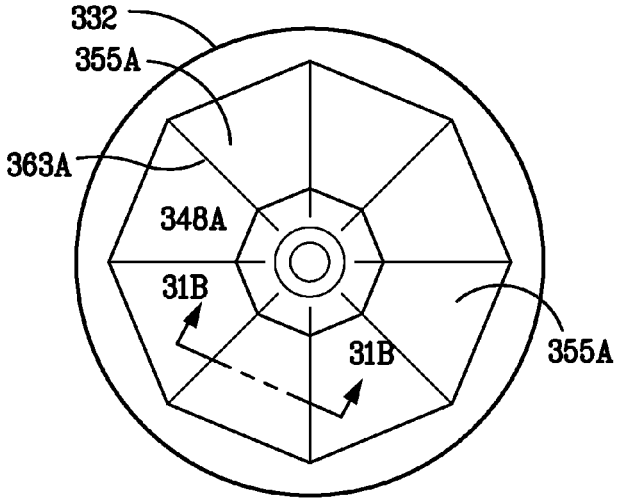
FIG. 31 A-E are schematic bottom plan views of the base illustrated in FIG. 23 having medial panels constructed in accordance with various alternative embodiments.
Figure 31B:
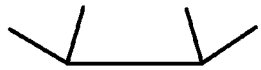
Figure 31C:
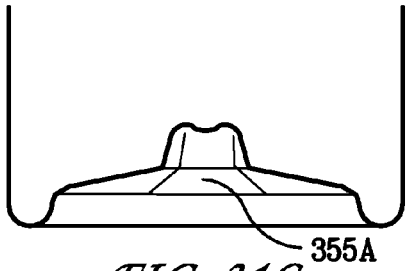
Figure 31D:
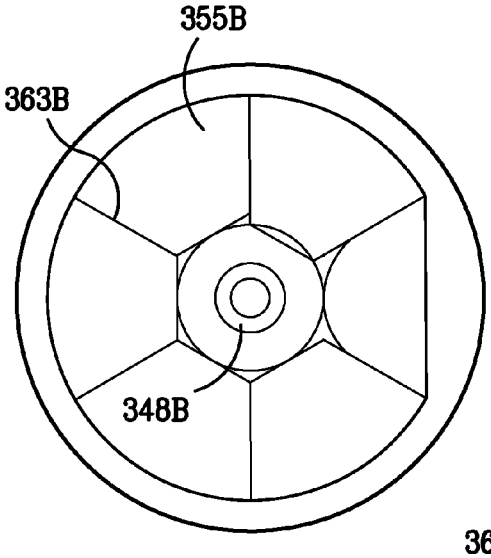
Figure 31E:
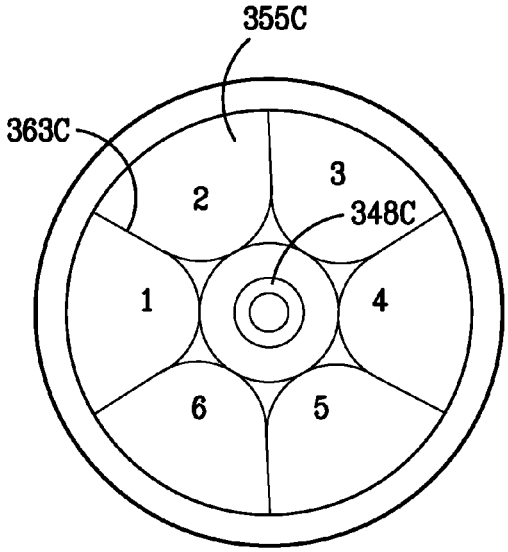

Referring also to FIG. 30, the change in container volume (CC) on the x-axis is plotted as a function of the increasing negative internal pressure on the y-axis. Each tick along the x-axis corresponds to 2.5 CC, such that the internal container volume changes in a positive direction from the origin along the x-axis. Each tick along the y-axis corresponds to 0.25 psi, such that the magnitude of negative internal pressure decreases in a positive direction from the origin along the y-axis.

As the deflection location 390 buckles, the base 332 deforms as a function of increasing negative internal pressure at a rate greater than the rate of base deformation as a function of negative internal pressure prior to buckling. Accordingly, as negative pressure begins to accumulate within the container, the base 332 begins to deform during a first deformation phase 395 which causes the container volume to decrease substantially linearly relative to the negative pressure increase. As the negative pressure continues to increase in magnitude, one or more of the deflection locations 390 buckles, at a second deformation, or deflection, phase 397, which causes the internal volume of the container to decrease as a function of increasing negative internal pressure at a rate greater than the rate of volume decrease as a function of negative internal pressure prior to buckling. During phase 397, the buckling of each deflection location 390 causes a momentary spike followed by a depression that reflects negative pressure dissipation in immediate response to buckling. It should be appreciated that one, some, or all deflection locations 390 may buckle during use, while other deflection locations 390 may not deflect, due to factors such as manufacturing tolerances, slightly varying material properties, orientation of the bottle, uneven cooling of the liquid, and the like. If the negative pressure increase continues after buckling, the base 332 can deform during a third deformation phase 399 which causes the container volume to decrease substantially linearly relative to the negative pressure increase until the base 332 achieves its deflected state.

It should be appreciated that the first and third deformations phase 95 and 99 include gradual base deformation. The second deformation phase, or deflection phase 97, is reflected in a sharp change in slope of the pressure vs. volume curve, even approaching a discontinuity of the curve.

It should be appreciated that the actual negative internal pressures and container volume decreases associated with the first, second, and third deformation phases can vary based on various factors, for instance the base geometry, including material thickness, size of the base and its components, placement of the various components of the base, and the like. In the illustrated embodiment, the rib 380 is configured to buckle prior to any deflection or substantial deformation of the cylindrical body 334 of the container 330.

It should be further appreciated that several example embodiments of a container base have been described, and that the described examples have been provided for the purpose of explanation and is not to be construed as limiting the invention. For instance, while embodiments have been presented including four deflection panels and eight deflection panels, it should be appreciated that any of the above embodiments could have any desired number of deflection panels including but not limited to any number between one and ten.

Furthermore, features and structures described above with reference to one or more embodiments can be applicable to the other embodiments.

Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the present invention. Those skilled in the relevant art, having the benefit of the teachings of this specification, may effect numerous modifications to the invention as described herein, and changes may be made without departing from the scope and spirit of the invention.

What is claimed:

1. A plastic container configured to absorb negative internal pressure, the plastic container comprising:

a container body defining an upper portion that extends upwardly to a finish, and an opposing lower portion;

an enclosed base connected to the lower portion of the container body, the base comprising:

a standing member configured to rest on a support surface;

a centrally disposed hub disposed radially inward from the standing member, said hub having a convex exterior wall directed toward a support surface upon which a base of the container is placed, said convex exterior wall defining an internal recess;

a base body including a wall that extends between the standing member and the central hub, said wall including a convex ring interface portion between the standing member and the central hub, at least one deflection rib attached to said wall and configured to buckle in response to a threshold level of negative internal pressure, the at least one deflection rib extending across said convex ring interface portion, wherein the base body can deform from an as-molded state to a deformed state in response to an increase in negative internal pressure, and further deformation of the base body in response to further increased negative internal pressure causes the rib to buckle, thereby allowing the base body to further deform from the deformed state to a deflected state.

2. The plastic container as recited in claim 1, wherein the base body further comprises, a first sloped surface at a position radially inward from a raised ring, a second sloped surface disposed proximate to the first sloped surface, said first and second sloped surfaces forming said convex ring interface portion, wherein said at least one deflection rib is connected between said first sloped surface and said second sloped surface.

3. The plastic container as recited in claim 2, wherein said at least one rib defines a closed perimeter.

4. The plastic container as recited in claim 2, wherein the first sloped surface slopes downward along a radially inward direction from the standing member toward the hub, and the second sloped surface slopes upward along the radially inward direction.

5. The plastic container as recited in claim 4, wherein the second sloped surface defines a flat medial panel.

6. The plastic container as recited in claim 1, wherein the base body further comprises an annular medial member disposed between the standing member and the hub, the annular medial member defines a plurality of flat panels adjoined at corresponding intersections, and said at least one rib is disposed at one of the intersections of a pair adjacent ones of the plurality of flat panels.

7. The plastic container as recited in claim 6, further comprising a plurality of ribs, wherein one of said ribs is disposed at each intersection.

8. The plastic container as recited in claim 1, wherein the container is a hot-fill plastic container.

9. A plastic container configured to deform from an undeformed state to a deflected state, the plastic container comprising:

a container body; and a base connected to the container body, the base comprising:

a peripherally located standing member;

a hub located in a center of said base and forming a convex, radiused shape extending toward a support surface upon which the container is placed; and a base body including a wall that extends from said standing member to said hub, said wall including a convex ring interface portion between said standing member and said hub, said base body including at least one rib attached to said wall and extending across said convex ring interface portion, said at least one rib being located between said standing member and said hub, and defining an enclosed perimeter, wherein said at least one rib is configured to create a deflection location in said at least one rib configured to buckle in response to deformation of said base from the undeformed state to the deflected state, thereby causing a portion of said base apart from said at least one rib to initially resist deflection.

10. The plastic container as recited in claim 9, wherein said base further comprises a plurality of flat medial panels, such that adjacent flat medial panels are adjoined at respective interfaces, and said at least one rib is disposed at one of the interfaces.

11. The plastic container of claim 1, wherein said base includes eight medial panels and eight deflection ribs, each of said medial panels and said ribs being spaced circumferentially about said base.

12. The plastic container of claim 9, wherein said base includes eight medial panels and eight deflection ribs, each of said medial panels and said ribs being spaced circumferentially about said base.

* * * * *